US009207699B2

(12) United States Patent
Takizawa

(10) Patent No.: US 9,207,699 B2
(45) Date of Patent: Dec. 8, 2015

(54) ELECTRIC POWER CONTROL SYSTEM AND ELECTRIC POWER CONTROL APPARATUS

(71) Applicant: CANON KABUSHIKI KAISHA, Tokyo (JP)

(72) Inventor: Masahiro Takizawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/569,519

(22) Filed: Dec. 12, 2014

(65) Prior Publication Data

US 2015/0168978 A1 Jun. 18, 2015

(30) Foreign Application Priority Data

Dec. 18, 2013 (JP) ..... 2013-260811

(51) Int. Cl.

| | |
|---|---|
| ***B41J 9/38*** | (2006.01) |
| ***B41J 2/00*** | (2006.01) |
| ***G05F 1/66*** | (2006.01) |
| ***B41J 29/38*** | (2006.01) |

(52) U.S. Cl.
CPC .. *G05F 1/66* (2013.01); *B41J 29/38* (2013.01)

(58) Field of Classification Search
USPC ..... 347/2, 5, 14, 16, 19, 110
See application file for complete search history.

(56) References Cited

U.S. PATENT DOCUMENTS

| | | | | |
|---|---|---|---|---|
| 5,517,317 | A * | 5/1996 | Kumada | 347/5 |
| 6,672,695 | B1 * | 1/2004 | Naka et al. | 347/7 |
| 2004/0021711 | A1 * | 2/2004 | Hasseler et al. | 347/7 |

FOREIGN PATENT DOCUMENTS

JP 2009-281885 A 12/2009

* cited by examiner

*Primary Examiner* — Kristal Feggins
(74) *Attorney, Agent, or Firm* — Canon USA, Inc. IP Division

(57) ABSTRACT

An electric power control system includes a first device, a second device, and an electric power control apparatus. The first device performs an operation when electric power is supplied via a first plug socket. The second device performs an operation when electric power is supplied via a second plug socket. The first and second devices communicate with each other. The electric power control apparatus controls the electric power supplied to the first device and the second device. The first device includes a notification unit to notify the electric power control apparatus of information indicating the second device that is a device relating to the first device. The electric power control apparatus includes an electric power control unit to stop supplying electric power to the second device based on the information notified from the notification unit when the electric power control unit stops supplying electric power to the first device.

12 Claims, 13 Drawing Sheets

FIG. 3

| 301 DEVICE NAME | 302 POWER SOURCE SYSTEM | 303 PLUG SOCKET ID | 304 IP ADDRESS OF ELECTRIC POWER METER | 305 IP ADDRESS OF DEVICE | 306 IP ADDRESS OF POWER SOURCE SET | 307 SHUTDOWN COMPLETION WAITING INSTRUCTION |
|---|---|---|---|---|---|---|
| ELECTRIC POWER CONTROL SERVER 101 | POWER LINE 130 | 1F_roomA_301 | 192.168.12.1 | 192.168.1.1 | – 310 | WAIT |
| ELECTRIC POWER LOAD 1 102 | POWER LINE 150 | 1F_roomA_504 | 192.168.12.37 | 192.168.1.15 | 192.168.1.16 | WAIT |
| ELECTRIC POWER LOAD 2 103 | POWER LINE 140 | 1F_roomA_413 | 192.168.12.230 | 192.168.1.16 | 192.168.1.15 | DO NOT WAIT |

FIG. 9

| 901 DEVICE NAME | 902 POWER SOURCE SYSTEM | 903 PLUG SOCKET ID | 904 IP ADDRESS OF METER | 905 IP ADDRESS OF DEVICE | 906 IP ADDRESS OF POWER SOURCE SET |
|---|---|---|---|---|---|
| ELECTRIC POWER CONTROL SERVER 101 | 130 | 1F_roomA_301 | 192.168.12.1 | 192.168.1.1 | – |
| MFP 500 | 150 | 1F_roomA_504 | 192.168.12.37 | 192.168.1.15 | 192.168.1.15 |
| ACCESSORY 550 | 140 | 1F_roomA_413 | 192.168.12.230 | 192.168.1.15 | 192.168.1.15 |
| COMPUTER 104 | 130 | 1F_roomA_305 | 192.168.12.31 | 192.168.1.20 | 192.168.1.20 |
| DISPLAY DEVICE 105 | 130 | 1F_roomA_306 | 192.168.12.45 | 192.168.1.20 | 192.168.1.20 |

910

911

ELECTRIC POWER CONTROL SYSTEM AND ELECTRIC POWER CONTROL APPARATUS

BACKGROUND OF THE INVENTION

1. Field of the Invention

The present invention relates to an electric power control system and an electric power control apparatus.

2. Description of the Related Art

An electric power meter that can measure electric power used in an ordinary home, a factory, or an office is conventionally known. An electric power control system discussed in Japanese Patent Application Laid-Open No. 2009-281885 includes a plurality of electric power meters respectively provided for electric power loads, generates data relating to working current used in each electric power load, and transmits the generated current data to an electric power control server. On the other hand, the electric power control server calculates a sum of working current values of respective electric power loads received from respective electric power meters. If the calculated sum exceeds a contract ampere, the electric power control server selects a corresponding detection apparatus and transmits a command instructing shutoff of electric power supplied to an electric power load.

As a result, the electric power control system discussed in Japanese Patent Application Laid-Open No. 2009-281885 can perform electric power shutdown processing for each electric power load when the working current exceeds the contract ampere, without causing a breaker to stop the electric power supply to all loads.

A printing system will be discussed below which includes a printing apparatus (e.g., a printer, a digital copying machine, a digital multifunction peripheral, or a facsimile apparatus), an accessory (e.g., a paper finisher) and a print server that can generate print image data. In such a printing system, it is general that the printing apparatus, the accessory, and the print server are connected to different AC power sources that are dedicated to respective devices. Further, the printing system is configured to perform a printing operation only when the electric power is supplied to all of the printing apparatus, the accessory, and the print server.

However, if the technique discussed in Japanese Patent Application Laid-Open No. 2009-281885 is applied to the above-mentioned printing system, the electric power supply to a part of a plurality of apparatuses whose power source systems are different will be stopped. Therefore, it is undesirable in that the electric power is uselessly consumed because the electric power is continuously supplied to the remaining apparatus, even though the entire printing system cannot perform operations normally.

For example, it is now assumed that electric power is continuously supplied to the print server and the accessory in a state where electric power supply to the printing apparatus is stopped. In this case, although the print server can generate print image data, the print server cannot transmit the generated print image data to the printing apparatus. Further, when the printing apparatus cannot print any image on a paper, no paper can be fed to the accessory. Therefore, the print server and the accessory may uselessly consume electric power.

SUMMARY OF THE INVENTION

The present invention is directed to a mechanism capable of preventing electric power from being continuously supplied to a part of devices that constitute an apparatus system in a state where the apparatus system cannot perform operations normally, thereby reducing an amount of uselessly consumed electric power.

According to an aspect of the present invention, an electric power control system includes a first device configured to perform an operation when electric power is supplied via a first plug socket, a second device configured to perform an operation when electric power is supplied via a second plug socket, which is different from the first plug socket, wherein the first device and the second device are connected in such a way as to communicate with each other, and an electric power control apparatus configured to control the electric power to be supplied to the first device and the second device. The first device includes a notification unit configured to notify the electric power control apparatus of information indicating the second device that is a device relating to the first device. The electric power control apparatus includes an electric power control unit configured to stop supplying electric power to the second device based on the information notified from the notification unit when the electric power control unit stops supplying electric power to the first device.

Further features of the present invention will become apparent from the following description of exemplary embodiments with reference to the attached drawings.

BRIEF DESCRIPTION OF THE DRAWINGS

FIG. 3 illustrates an example of a power source management table according to the first exemplary embodiment.

FIG. 8, which includes

FIG. 9 illustrates an example of a power source management table according to the second exemplary embodiment.

DESCRIPTION OF THE EMBODIMENTS

Various exemplary embodiments, features, and aspects of the invention will be described in detail below with reference to the drawings.

Exemplary embodiments of the present invention defined by the claims are not limited to only the following exemplary embodiments. Further, it should be noted that all of possible combinations of characteristic features described in the following exemplary embodiments are not always essential features of the present invention.

Figure 1:
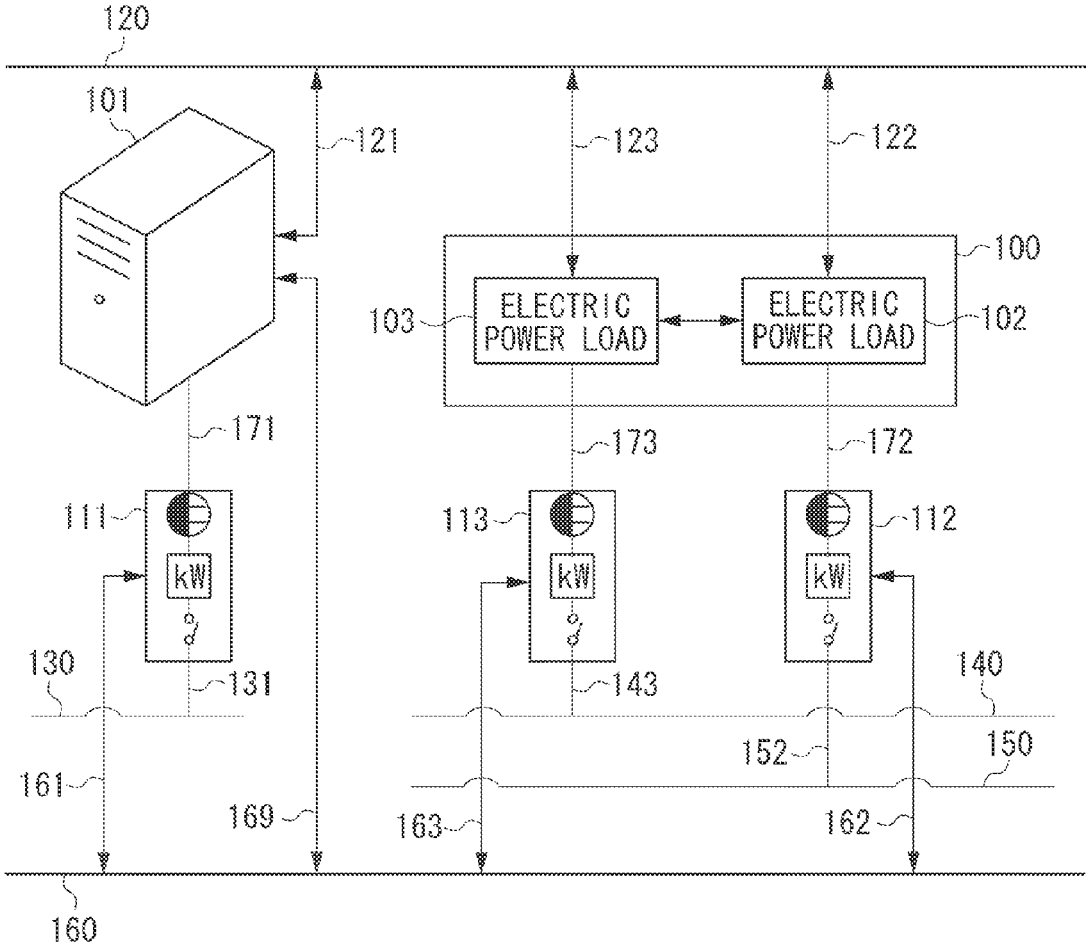
FIG. 1 illustrates an example of an electric power control system according to a first exemplary embodiment.

FIG. 1 illustrates a configuration example of an electric power control system according to a first exemplary embodiment of the present invention. As illustrated in FIG. 1, the electric power control system according to the first exemplary embodiment includes an electric power control server 101, an electric power meter 111, an electric power meter 112, and an electric power meter 113.

An apparatus system (i.e., a device system) 100 includes at least one apparatus (i.e., electric power load). There is a plurality of plug sockets (i.e., power lines) via which electric power can be supplied to the apparatus system 100. For example, the apparatus system 100 is a home appliance device, an information device, an acoustic imaging apparatus, a game console, a manufacturing apparatus, a financial device, a transportation system, or a security apparatus. Although the apparatus system 100 includes an electric power load 102 and an electric power load 103 as described below, the apparatus system 100 can include three or more electric power loads.

In the present exemplary embodiment, the apparatus system 100 can be a home appliance system, such as an air conditioning system. In this case, the electric power load 102 is, for example, an air conditioning outdoor unit. The electric power load 103 is, for example, an air conditioning indoor unit. Further, the apparatus system 100 can be an information system. In this case, the electric power load 102 is, for example, a personal computer. The electric power load 103 is, for example, a display device or a network device.

Further, the apparatus system 100 can be an acoustic imaging system. In this case, the electric power load 102 is, for example, an acoustic imaging player. The electric power load 103 is, for example, a display device or an amplification device. Further, the apparatus system 100 can be a game console. In this case, the electric power load 102 is, for example, a game console unit. The electric power load 103 is, for example, a display device, an amplification device, or a network device.

Further, the apparatus system 100 can be a manufacturing system. In this case, the electric power load 102 is, for example, a manufacturing robot. The electric power load 103 is, for example, a robot control apparatus. Further, the apparatus system 100 can be a financial device, such as an automated teller machine system. In this case, the electric power load 102 is, for example, an automated teller machine. The electric power load 103 is, for example, a network device or server.

Further, the apparatus system 100 can be a transportation system, such as an automatic ticket gate system. In this case, the electric power load 102 is, for example, an automatic ticket gate. The electric power load 103 is, for example, a network device or a server. Further, the apparatus system 100 can be a security system, such as a monitoring camera or an infrared beam sensor. The electric power load 102 is, for example, a sensing device, such as a monitoring camera or an infrared beam sensor. The electric power load 103 is, for example, a display device, a storage device, or a report apparatus.

Electric power can be supplied to the electric power load 102 via a power line 172 and the electric power meter 112 from a power line 150. Similarly, electric power can be supplied to the electric power load 103 via a power line 173 and the electric power meter 113 from a power line 140. The electric power load 102 and the electric power load 103 have a predetermined relationship. In a state where no electric power is supplied to either the electric power load 102 or the electric power load 103, the apparatus system 100 cannot realize its functions in whole or in part. More specifically, to enable the apparatus system 100 to perform all functions, it is necessary to supply electric power to all electric power loads provided in the apparatus system 100.

The electric power load 102 and the electric power load 103 are connected to a communication line 120, such as Ethernet (registered trademark), via communication lines 122 and 123, respectively. The electric power load 102 and the electric power load 103 can communicate with each other via the communication line 120. Further, each of the electric power load 102 and the electric power load 103 can communicate with any other device (e.g., the electric power control server 101) accessible via the communication line 120.

The electric power control server 101 can communicate with each of the electric power meter 111, the electric power meter 112, and the electric power meter 113 to acquire data relating to voltage, current, electric power, or electric power amount. More specifically, the electric power control server 101 can communicate with the electric power meter 111, the electric power meter 112, and the electric power meter 113 via a communication line 160, such as Ethernet (registered trademark). Electric power can be supplied to the electric power control server 101, via a power line 171 and the electric power meter 111, from a power line 130. The electric power control server 101 has an internal configuration described below.

The electric power meter 111 can transmit data relating to voltage and current of the power line 171 of the electric power control server 101 or data relating to electric power (or electric power amount) consumed by the electric power control server 101 to the electric power control server 101 via communication lines 161, 160, and 169. The electric power meter 111 includes a switch capable of selectively disabling (OFF) or enabling (ON) electric power supply to the electric power control server 101 in response to an instruction received from the electric power control server 101 via the communication lines 169, 160, and 161. When the electric power control server 101 performs an operation, the electric power meter 111 closes (turns on) the above-mentioned switch.

The electric power meter 112 can transmit data relating to voltage and current of the power line 172 of the electric power load 102 or data relating to electric power (or electric power amount) consumed by the electric power load 102 to the electric power control server 101 via communication line 162. Similarly, the electric power meter 113 can transmit data relating to voltage and current of the power line 173 of the electric power load 103 or data relating to electric power (or electric power amount) consumed by the electric power load 103 to the electric power control server 101 via communication lines 163.

The electric power meter 112 includes a switch capable of selectively disabling (OFF) or enabling (ON) electric power supply to the electric power load 102 in response to an instruction received from the electric power control server 101 via the communication line 162. The electric power meter 113 includes a switch capable of selectively disabling (OFF) or enabling (ON) electric power supply to the electric power load 103 in response to an instruction received from the electric power control server 101 via the communication line 163. When the electric power load 102 performs an operation, the electric power meter 112 closes (turns on) the above-mentioned switch. Each of the electric power meters 111, 112 and 113 has a configuration described in detail below.

The power lines 130, 140, and 150 are power lines of AC 100 V power source, respectively. It is needless to say that the present invention is not limited to 100 V.

The communication line 120 is connected to the electric power control server 101 via a communication line 121. The communication line 120 is connected to the electric power load 102 via the communication line 122. The communication line 120 is connected to the electric power load 103 via the communication line 123. In other words, the electric power control server 101 can communicate with the electric power loads 102 and 103 via the communication lines 121, 122, and 123.

Each of the communication lines 120 and 160 is not limited to the Ethernet (registered trademark) type and can be a wired communication type, such as RS-232 or Power Line Communication (PLC). Further, each of the communication lines 120 and 160 can be a wireless communication type, such as wireless Local Area Network (LAN), Bluetooth (registered trademark), ZigBee (registered trademark), Radio Frequency IDentification (RFID), or wireless Universal Serial Bus (USB).

In the present exemplary embodiment, only one electric power load is connected to each electric power meter. However, the above-mentioned system configuration can be modified in such a way as to connect a plurality of electric power loads to each electric power meter. The number of the electric power meters and the number of the electric power loads are not limited to the above-mentioned example. The electric power control system can be configured to include a plurality of apparatus systems 100.

Figure 12:
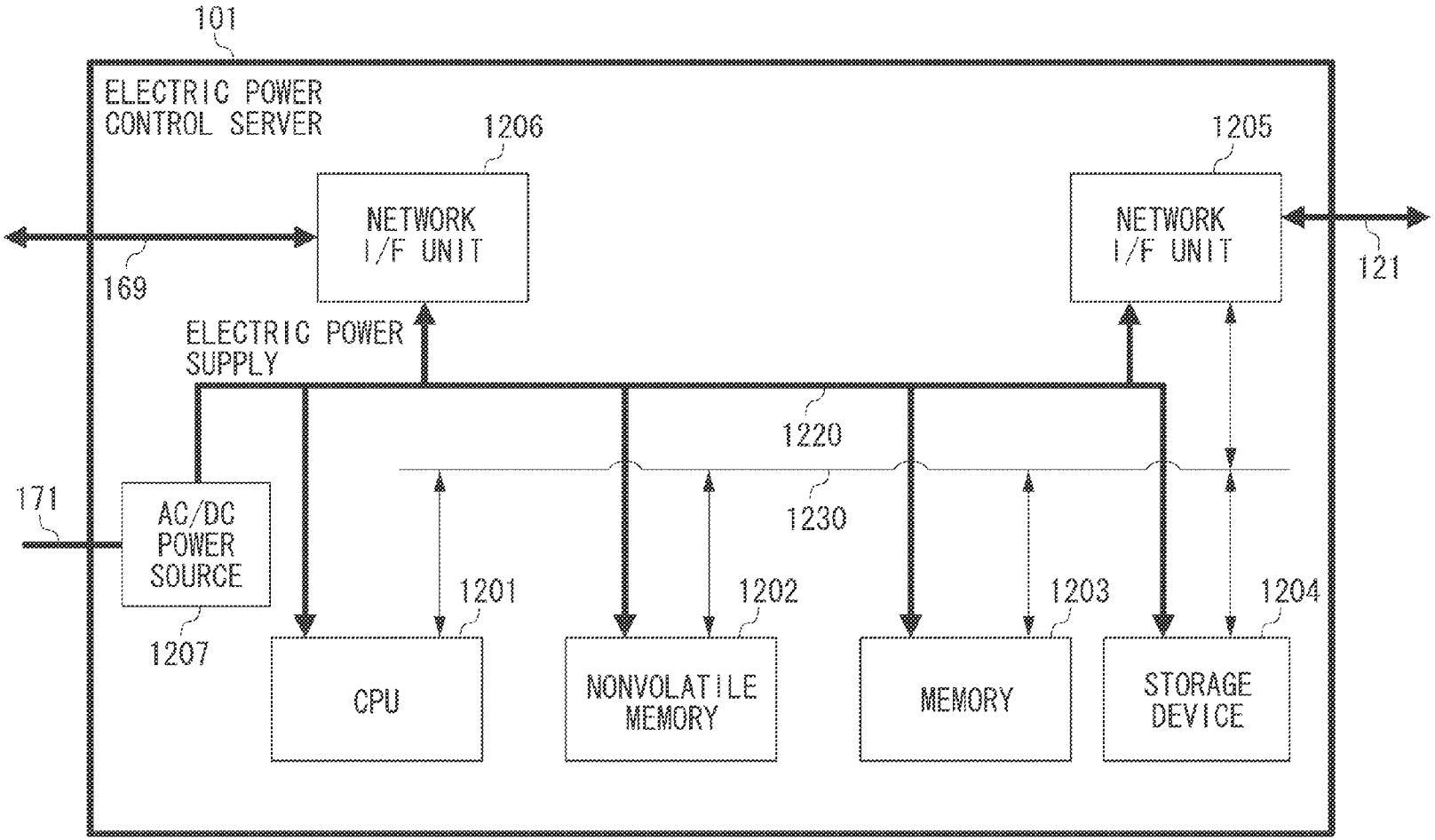
FIG. 12 illustrates a configuration example of an electric power control server.

Next, a configuration of the electric power control server 101 is described in detail below with reference to FIG. 12. FIG. 12 is a block diagram illustrating a configuration example of the electric power control server 101. In FIG. 12, a central processing unit (CPU) 1201 can execute various programs including a control processing routine described below. The CPU 1201 is functionally operable as a detection unit, a notification unit, and a power source control unit of the electric power control system according to the present exemplary embodiment by performing various controls based on computer readable programs stored in a nonvolatile memory 1202 and a storage device 1204.

The nonvolatile memory 1202 is, for example, a read only memory (ROM). The nonvolatile memory 1202 stores a startup program for the CPU 1201 and various programs to realize various operations according to control processing routines described below. A random access memory (RAM) 1203 can be used as a work area when the CPU 1201 executes various programs or an image memory that temporarily stores image data.

Each of two network I/F units 1205 and 1206 is, for example, constituted by a network interface card (NIC). The network I/F unit 1205 is connected to the LAN 121 and can perform various network controls, including communications with the apparatus system 100. The network I/F unit 1206 is connected to the LAN 169 and can perform various network controls, including communications with the electric power meters 111, 112, and 113. Although the electric power control server 101 includes two network I/F units 1205 and 1206 as mentioned above, the number of network I/F units is not limited to two. The electric power control server 101 can include one network I/F unit or three or more network I/F units.

The storage device 1204 is, for example, constituted by a hard disk or a Solid State Disk (SSD). The storage device 1204 stores a startup program for the CPU 1201 and various programs to realize various operations according to control processing routines described below.

An AC-DC power source 1207 can generate electric power to be supplied to each portion of the electric power control server 101. A power source line 1220 supplies electric power to each portion of the electric power control server 101. A bus 1230 enables each unit of the electric power control server 101 to communicate with other units. Each of the electric power load 102 and the electric power load 103 has a configuration similar to the configuration of the electric power control server 101 illustrated in FIG. 12.

Figure 2:
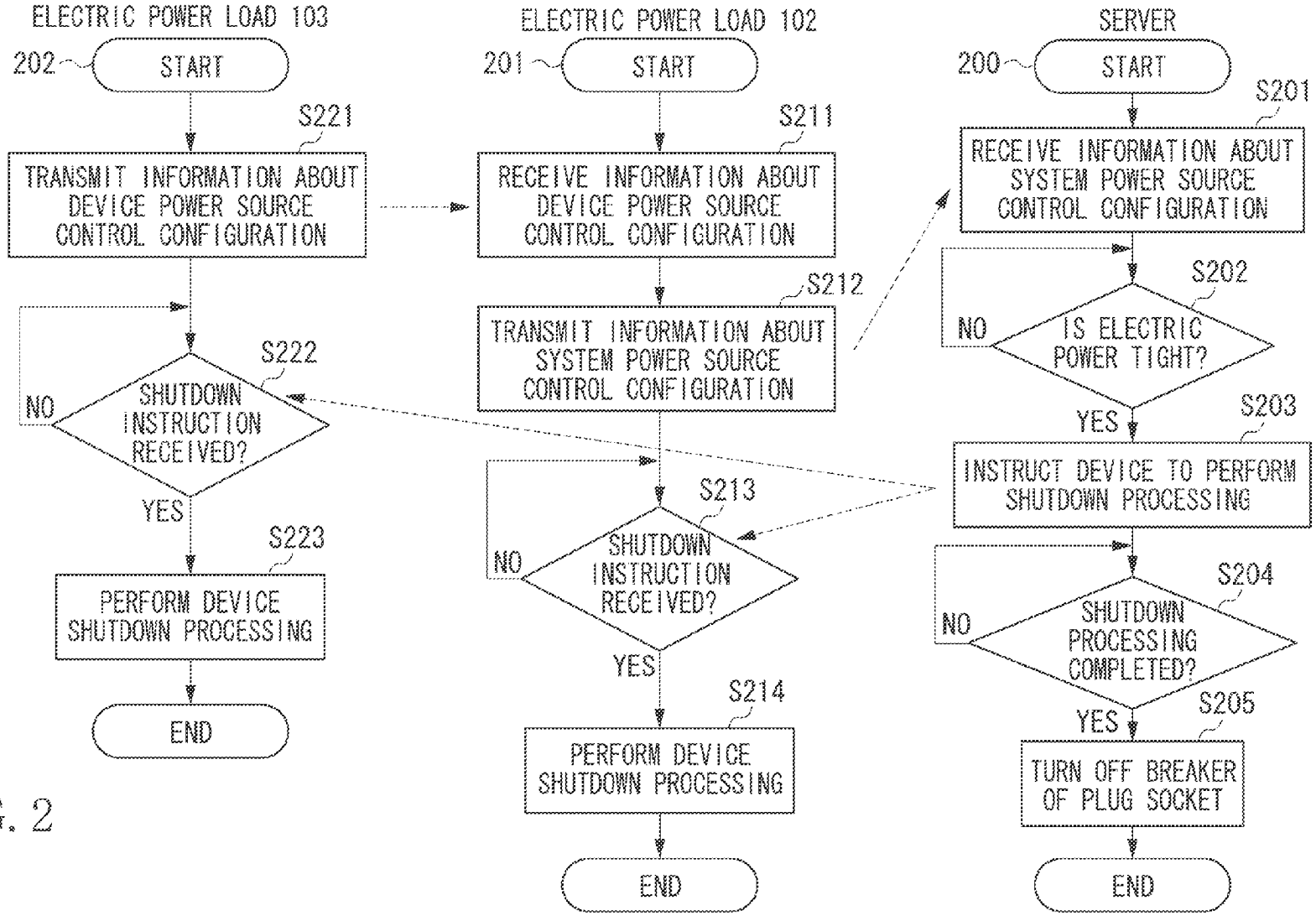
FIG. 2 is a flowchart illustrating an operation that can be performed by the electric power control system according to the first exemplary embodiment.

Next, operations that can be performed by the apparatus system 100 and the electric power control server 101 according to the first exemplary embodiment are described in detail below with reference to FIG. 2. FIG. 2 is a flowchart illustrating an example of the operations that can be performed by the apparatus system 100 and the electric power control server 101 according to the first exemplary embodiment.

In FIG. 2, a flowchart 200 illustrates an example of the processing that can be performed by the CPU 1201 provided in the electric power control server 101. A program including the processing of the flowchart 200 is stored in the memory 1203, the nonvolatile memory 1202, or the storage device 1204 provided in the electric power control server 101. Further, a flowchart 201 illustrates an example of the processing that can be performed by a CPU (not illustrated) of the electric power load 102 included in the apparatus system 100. A program including the processing of the flowchart 201 is stored in a memory (not illustrated) of the electric power load 102. Further, a flowchart 202 illustrates an example of the processing that can be performed by a CPU (not illustrated) of the electric power load 103 provided in the apparatus system 100. A program including the processing of the flowchart 202 is stored in a memory (not illustrated) of the electric power load 103.

First, an example of the operation that can be performed step by step by the electric power load 103 is described in detail below with reference to the flowchart 202. In step S221, the electric power load 103 transmits information about the power source control configuration of the electric power load 103 to the electric power load 102. The information about the power source control configuration of the electric power load 103 includes information that identifies the electric power load 103 (hereinafter, referred to as "identification information") and identification information about a plug socket (or power line) connected to the electric power load 103. In the present exemplary embodiment, the identification information about the electric power load 103 and the identification information about the plug socket (or power line) are, for example, expressed as Internet Protocol (IP) addresses.

However, the identification information about the electric power load 103 and the identification information about the plug socket (or power line) are not limited to IP addresses. For example, any other appropriate information (e.g., Media Access Control (MAC) address or RFID) can be used as identification information.

Further, in a case where the plug socket (or power line) to be connected to the electric power load 103 is determined beforehand, it is unnecessary to transmit the identification information about the plug socket (or power line) connected to the electric power load. Further, although the information about the electric power load 103 is transmitted to the electric power load 102 as described above for illustrative purposes, the processing according to the present exemplary embodiment can be modified appropriately. For example, the identification information about the electric power load 103 can be directly transmitted to the electric power control server 101.

Next, in step S222, the electric power load 103 determines whether a power shutdown preparatory processing instruction (i.e., "shutdown instruction" described in FIG. 2) has been received. For example, the electric power load 103 waits for a while until a signal or a command indicating the power shutdown preparatory processing instruction is received from the electric power control server 101. Although the electric power load 103 is configured to receive the power shutdown preparatory processing instruction from the electric power control server 101 as described above for illustrative purposes, the present exemplary embodiment can be modified appropriately. For example, the electric power load 103 can be configured to receive the power shutdown preparatory processing instruction from the electric power load 102. If the electric power load 103 determines that the power shutdown preparatory processing instruction has been received (Yes in step S222), the operation proceeds to step S223.

In step S223, the electric power load 103 performs power shutdown preparatory processing (i.e., "shutdown processing" described in FIG. 2) relating to the electric power load 103. The power shutdown preparatory processing to be performed in step S223 can bring the electric power load 103 into a state ready for electric power shutdown. For example, the electric power load 103 transmits local information to the electric power load 102 or other device (e.g., a cloud server) to synchronize the information. Alternatively, the electric power load 103 writes information stored in a volatile memory (e.g., dynamic random access memory DRAM), in a nonvolatile storage device (e.g., a hard disk or a flash ROM) or transmits the information to a network device.

Further, in a case where the electric power load 103 does not possess any local information or volatile information, it is unnecessary for the electric power load 103 to do the above-mentioned processing. Further, in a case where the electric power load 103 includes a shutdown operation mechanism capable of stopping electric power supply to the electric power load 103, the electric power load 103 can cause the mechanism to perform a shutdown operation.

Further, in this case, if the electric power load 103 includes a mechanical mechanism, the electric power load 103 can cause the mechanical mechanism to interrupt the operation and move to a position where the operation of the mechanical mechanism can be stabilized. Further, in this case, if the electric power load 103 includes an energy mechanism (e.g., a heater or a burner), the electric power load 103 can stop energy supply to the energy mechanism and cool the mechanism body in such a way as to prevent the energy mechanism from failing or being damaged.

Next, an example of the operation that can be performed step by step by the electric power load 102 is described in detail below with reference to the flowchart 201. In step S211, the electric power load 102 receives information about the power source control configuration of the electric power load 103 (i.e., another electric power load that constitutes the apparatus system 100). Although there is only one electric power load (i.e., the electric power load 103) remaining in FIG. 1, the apparatus system 100 can be configured to include two or more other electric power loads. The information about the power source control configuration of the electric power load 103 is already mentioned in step S221 and therefore detailed description thereof will be avoided.

Next, in step S212, the electric power load 102 transmits information about the power source control configuration of the apparatus system 100, which includes the information about the power source control configuration of the electric power load 103 (i.e., the above-mentioned information received in step S211) and information about the power source control configuration of the electric power load 102, to the electric power control server 101. The information about the power source control configuration of the electric power load 102 includes identification information about the electric power load 102 and identification information about a plug socket (or power line) connected to the electric power load 102. The identification information about the electric power load 102 and the identification information about the plug socket (or power line) connected to the electric power load 102 are similar to the identification information about the electric power load 103 and the identification information about the plug socket (or power line) connected to the electric power load 103 already mentioned in step S221. Therefore, detailed description thereof will be avoided.

Further, the information about the power source control configuration of the apparatus system 100 includes information about combination, order, and time difference with respect to the electric power loads of the apparatus system 100 to be subjected to the power shutdown processing. In the present exemplary embodiment, the power shutdown processing is performed simultaneously on the electric power load 102 and the electric power load 103 for illustrative purposes. Further, the information about the power source control configuration of the apparatus system 100 includes information indicating that the apparatus system 100 cannot operate normally when the electric power supply to one of the electric power load 102 and 103 is stopped.

Next, in step S213, the electric power load 102 determines whether the power shutdown preparatory processing instruction (i.e., "shutdown instruction) has been received. For example, the electric power load 102 waits for a while until a signal or a command indicating the power shutdown preparatory processing instruction is received from the electric power control server 101. The processing to be performed in step S213 is similar to the processing performed in step S222. Therefore, detailed description thereof will be avoided. If the electric power load 102 determines that the power shutdown preparatory processing instruction has been received (Yes in step S213), the operation proceeds to step S214.

In step S214, the electric power load 102 performs power shutdown preparatory processing (i.e., the shutdown processing) relating to the electric power load 102. The processing to be performed in step S214 is similar to the processing performed in step S223 and therefore detailed description thereof will be avoided. Although the electric power load 102 performs the power shutdown preparatory processing as mentioned above, it is also useful to instruct the remaining electric power load (e.g., the electric power load 103) constituting the apparatus system 100 to perform power shutdown preparatory processing if the power shutdown preparatory processing instruction is received in step S214.

Next, an example of the operation that can be performed step by step by the electric power control server 101, included in the configuration example illustrated in FIG. 1, is described in detail below with reference to the flowchart 200. In step S201, the electric power control server 101 receives the above-mentioned information about the power source control configuration of the apparatus system 100 (i.e., the information received from the electric power load 102 in the present exemplary embodiment). In the present exemplary embodiment, in a case where the plug socket (or power line) connected to each electric power load is determined beforehand, it is presumed that device name of the electric power load, identification information about the plug socket, and identification information about an electric power meter corresponding to the plug socket are associated with each other and the relationship thereof is registered beforehand in the electric power control server 101.

The identification information about the electric power meter is, for example, IP address or MAC address of the electric power meter, which is similar to other identification information. The electric power control server 101 generates a power source management table (e.g., illustrated in FIG. 3)

that manages identification information about respective electric power meters, which are connected to the electric power loads 102 and 103, based on the above-mentioned received information about the power source control configuration of the apparatus system 100.

The information stored in the power source management table includes device unique information (e.g., IP address or MAC address) of each electric power load, name of a plug socket (or power line) connected to the electric power load, identification information about each electric power meter, and the power source system which are associated with the device name (e.g., the electric power loads 102 and 103). Further, the above-mentioned power source management table can be used to manage the name of each plug socket (or power line) connected to the electric power control server 101, identification information about each electric power meter, and the power source system. The power source management table will be described in detail below.

In the present exemplary embodiment, as described above, the electric power control server 101 is configured to receive the configuration information about respective electric power loads of the apparatus system 100 from the electric power load 102, for illustrative purposes. However, the system configuration can be modified appropriately. For example, the electric power control server 101 can be modified to receive the information about power source control configuration of respective electric power load 102 and 103 from the electric power load 103 or can be modified to receive the power source control configuration information from each of the electric power loads 102 and 103. Further, in a case where a plug socket (or power line) connected to an electric power load is determined beforehand, it is unnecessary for the electric power control server 101 to receive the identification information about the plug socket (or power line) connected to the electric power load.

Next, in step S202, the electric power control server 101 determines whether the electric power is in a tight state with respect to the power lines 130, 140, and 150 (i.e., the power source systems in the present exemplary embodiment) of the electric power control server 101 and respective electric power loads 102 and 103, with reference to the above-mentioned power source management table. First, the electric power control server 101 receives electric power consumption information from the electric power meters 111, 112, and 113 that are connected to the plug sockets of the electric power control server 101 and the electric power loads 102 and 103. Then, the electric power control server 101 obtains electric power consumption in each power source system (i.e., each of the power lines 130, 140, and 150 in the present exemplary embodiment).

For example, in a case where a plurality of electric power meters is connected to a single power source system, a sum of electric power consumptions measured by respective electric power meters is a total electric power consumption of the power source system. Alternatively, it is useful to provide a dedicated electric power meter for each power source system (i.e., each of the power lines 130, 140, and 150) to obtain electric power consumption of each power source system.

Next, the electric power control server 101 compares a predetermined threshold value (e.g., an upper-limit value of electric power consumption) having been set beforehand for each power source system (i.e., each of the power lines 130, 140, and 150) with the electric power consumption of each power source system (i.e., each of the power lines 130, 140, and 150). If the electric power consumption of each power source system (i.e., each of the power lines 130, 140, and 150) does not exceed the threshold value, the electric power control server 101 determines that the electric power is not tight. The determination result in step S202 is NO. Therefore, the electric power control server 101 repeats the determination processing in step S202.

On the other hand, if the electric power consumption of any one of the power source systems (i.e., the power lines 130, 140, and 150) is greater than the threshold value, the electric power control server 101 determines that the electric power is tight. The determination result in step S202 is YES. Therefore, the operation of the electric power control server 101 proceeds to step S203.

In step S203, the electric power control server 101 instructs the apparatus system 100 (i.e., the device connected to the power source system whose electric power is tight) to perform power shutdown preparatory processing (i.e., "shutdown processing" described in FIG. 2). For example, when the electric power of the power line 150 is tight, the electric power control server 101 instructs the electric power load 102 (i.e., the device connected to the power line 150) to perform power shutdown preparatory processing, with reference to the above-mentioned power source management table (see FIG. 3). Further, the electric power control server 101 instructs the electric power load 103 (i.e., the remaining power load that constitutes the apparatus system 100 together with the electric power load 102) to perform power shutdown preparatory processing, with reference to the power source management table.

In the present exemplary embodiment, for illustrative purposes, the electric power control server 101 sequentially transmits the power shutdown preparatory processing instructions to the electric power load 102 and the electric power load 103 in this order. However, for example, as a modified embodiment, the electric power control server 101 can simultaneously transmit the power shutdown preparatory processing instruction to both of the electric power load 102 and the electric power load 103. Alternatively, the electric power control server 101 can sequentially transmit the power shutdown preparatory processing instructions to the electric power load 103 and the electric power load 102 in this order. Further, the electric power control server 101 can transmit an electric power shutdown notification, instead of transmitting the power shutdown preparatory processing instruction.

Next, in step S204, the electric power control server 101 determines whether the power shutdown preparatory processing (i.e., the shutdown processing) has been completed in the device connected to the power line whose electric power is tight. For example, in a case where the electric power load 102 and the electric power load 103 are information devices that require a significant amount of time to complete the power shutdown preparatory processing, the electric power control server 101 waits until the power shutdown preparatory processing completes.

In a case where the electric power load 102 and the electric power load 103 are devices capable of completing the power shutdown preparatory processing within a comparatively short time, it is unnecessary to provide a waiting time before completing the power shutdown preparatory processing of the apparatus system 100. In this case, information described in the above-mentioned power source management table (see 307 illustrated in FIG. 3) can be referred to when the electric power control server 101 determines whether to wait for a while until the power shutdown preparatory processing completes.

In determining whether the device connected to the power line whose electric power is tight has been shut down, the electric power control server 101 can communicate with an output meter connected to the device to monitor the electric power consumption and can determine that the shutdown processing has been completed when the electric power consumption of the device reaches a predetermined value (i.e., a power consumption value in a shutdown completion state). The power consumption value in the shutdown completion state of each device can be registered beforehand in the electric power control server 101 or can be acquired in the above-mentioned step S201.

Further, in a case where the information acquired in the above-mentioned step S201 includes time required for the device to complete the shutdown processing, the electric power control server 101 can determine that the shutdown processing of the device has been completed when the time has elapsed. The time required for each device to complete the shutdown processing can be registered beforehand in the electric power control server 101.

If the electric power control server 101 determines that the power shutdown preparatory processing is not yet completed in the apparatus system 100 connected to the power line whose electric power is tight (No in step S204), the electric power control server 101 repeats the determination processing in step S204. On the other hand, if the electric power control server 101 determines that the power shutdown preparatory processing has been completed in the apparatus system 100 connected to the power line whose electric power is tight (Yes in step S204), the operation proceeds to step S205.

In step S205, the electric power control server 101 instructs the electric power meter connected to the apparatus system 100 connected to the power line whose electric power is tight, to stop the electric power supply operation (i.e., turn off the breaker of the plug socket illustrated in FIG. 2). For example, the electric power control server 101 issues a command to stop the electric power supply operation for IP address or MAC address of respective electric power meters 112 and 113 described in the above-mentioned power source management table and gives an instruction in such a way as to supply no electric power to respective power lines 172 and 173 connected to the electric power meters 112 and 113. In response to the above-mentioned instruction, each of the electric power meters 112 and 113 turns off a switch 1003 (see FIG. 10 or FIG. 11) to stop the electric power supply operation for the device. As mentioned above, in the present exemplary embodiment, the power source of the system illustrated in FIG. 1 can be managed appropriately.

Next, the power source management table of the electric power control system according to the first exemplary embodiment is described in detail below with reference to FIG. 3. FIG. 3 illustrates an example of the power source management table that indicates power lines to which the apparatus system 100 illustrated in FIG. 1 is connected, communication destinations of the apparatus system 100, and a relationship between constituent devices of the apparatus system 100 to be subjected to the power source shutdown processing.

The power source management table is stored in the memory 1203 or the storage device 1204 of the electric power control server 101. Further, the power source management table illustrated in FIG. 3 can be generated in step S201 illustrated in FIG. 2 (i.e., by the processing to be performed by the CPU 1201 provided in the electric power control server 101) and can be referred to in step S202, step S203, step S204, and step S205. A data format (character string) of FIG. 3 is easy for a user to recognize. However, any other data format (e.g., binary value or alphanumeric data) that can be easily managed by the electric power control server 101 is employable as the data format of FIG. 3.

In FIG. 3, a data string 301 indicates device name of each device (i.e., each of the electric power control server 101 and the electric power loads 102 and 103). The device name 301 is described in step S201 illustrated in FIG. 2. Alternatively, the device name 301 can be described beforehand. A data string 302 indicates power source system (power line) to which each device of the device name 301 is connected.

A data string 303 indicates plug socket ID usable to identify a plug socket and an electric power meter to which each device of the device name 301 is connected. The plug socket ID 303 is information differentiated for each plug socket to uniquely identify the plug socket and the electric power meter. For example, MAC address or IP address of each electric power meter is usable as the plug socket ID 303. The plug socket ID 303 is described in step S201 illustrated in FIG. 2. Alternatively, the plug socket ID 303 can be described beforehand. For example, to connect each device of the device name 301 to a proper plug socket, a data format (character string) of the plug socket ID 303 is easy to understand. For example, "1F_roomA_504" of the plug socket ID 303 (i.e., the data described in line 310 and row 303) indicates a plug socket #504 in a room "A" located on the first floor of a building.

A data string 304 indicates communication destination of an electric power meter to which each device of the device name 301 is connected. The information about the communication destination 304 of the electric power meter can be referred to when the electric power control server 101 communicates with respective electric power meters. The communication destination 304 described in the table is IP address of each electric power meter. However, any other information (e.g., MAC address of the electric power meter) usable to communicate with the electric power meter is employable to describe the communication destination 304. The communication destination 304 of each electric power meter is described in step S201 illustrated in FIG. 2. Alternatively, the communication destination 304 can be described beforehand. The communication destination 304 can be referred to in step S202.

A data string 305 indicates communication destination of each device of the device name 301. The information about the device communication destination 305 can be referred to when the electric power control server 101 communicates with each device of the device name 301. The device communication destination 305 described in the table is IP address of each device of the device name 301. However, any other information (e.g., MAC address of each device of the device name 301) usable to communicate with the device of the device name 301 is employable to describe the device communication destination 305. The device communication destination 305 is described in step S201 illustrated in FIG. 2.

A data string 306 indicates a device constituting the apparatus system together with the device of the device name 301. The number of the data 306 is equal to the number of devices that constitute the apparatus system together with the device of the device name 301. In the present exemplary embodiment, the data 306 described in the table is IP address of the device of the device name 301. However, any other information usable to communicate with the device of the device name 301 (e.g., MAC address of the device of the device name 301) is employable to described the data 306. The communication destination 306 of each constituent device of the apparatus system is described in step S201 illustrated in FIG. 2 and can be referred to in step S203, step S204, and step S205.

In the present exemplary embodiment, only one destination is described as the communication destination 306 for illustrative purposes. However, it is feasible to describe a plurality of pieces of information. For example, in a case where the apparatus system includes two or more constituent devices, two or more IP addresses are described in the communication destination 306.

A data string 307 indicates information indicating whether to wait until the shutdown processing completes for the device of the device name 301 in a case where the power supply shutdown (plug socket breaker OFF) instruction is transmitted to the electric power meter of a plug socket connected to the device of the device name 301. The power source management table illustrated in FIG. 3 includes information relating to the electric power load 102 described in a data row 310.

As mentioned above, the system having the configuration illustrated in FIG. 1 can manage the power source by performing processing according to the flowchart illustrated in FIG. 2 and can perform a shutdown operation in such a way as to entirely stop the electric power supply to the apparatus system 100 having a plurality of plug sockets, with reference to the power source management table illustrated in FIG. 3. As a result, the electric power control system according to the first exemplary embodiment can prevent electric power from being uselessly consumed, because the electric power is not continuously supplied to the electric power loads of the apparatus system 100 when the apparatus system 100 cannot operate normally.

Figure 4:
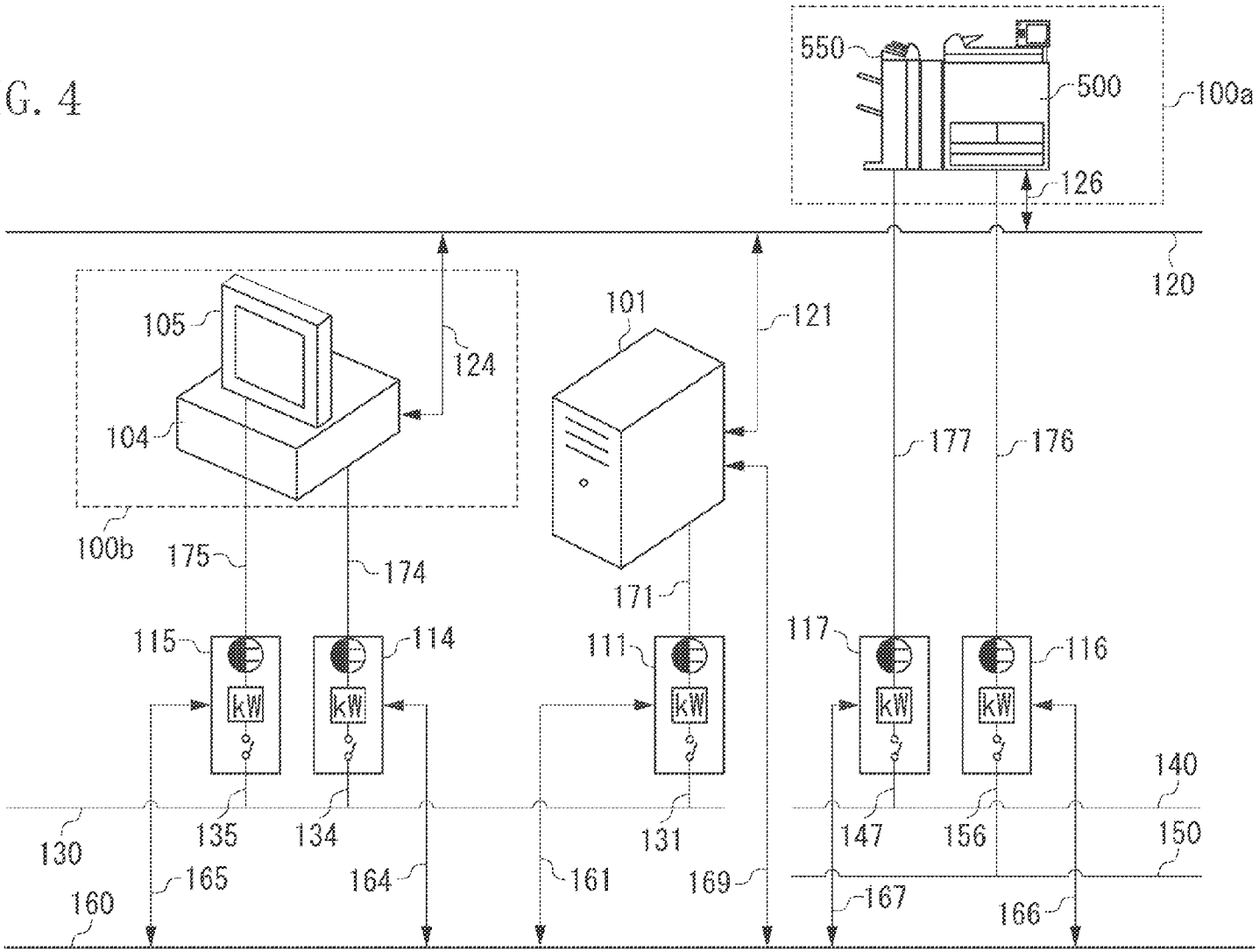
FIG. 4 illustrates an example of an electric power control system according to a second exemplary embodiment.

A second exemplary embodiment is described in detail below with reference to the attached drawings. FIG. 4 illustrates a configuration example of an electric power control system according to the second exemplary embodiment of the present invention. The electric power control system illustrated in FIG. 4 includes an apparatus system 100*a*, an apparatus system 100*b*, an electric power meter 114, an electric power meter 115, an electric power meter 116, and an electric power meter 117, in addition to the electric power control server 101 and the electric power meter 111 described in the above-mentioned exemplary embodiment. The electric power control server 101, the electric power meter 111, the communication lines 120 and 160, the power lines 130, 140, and 150 are similar to those described in the first exemplary embodiment (see FIG. 1) and therefore detailed description thereof will be avoided.

Each of the apparatus systems 100*a* and 100*b* is an apparatus system having a plurality of plug sockets (power lines). The apparatus system 100*a* is a printer system (i.e., an image forming system), which are constituted by a multi function peripheral (MFP) 500 and an accessory 550, as described in detail below. The computer system 100*b* is constituted by a personal computer (PC) 104 and a display device 105, as described below.

Hereinafter, the MFP 500 and the accessory 550 that cooperatively constitute the printer system 100*a* are described in detail below. The MFP 500 is an integrated device having copy, printer, and scanner functions. Electric power can be supplied to the MFP 500 via a power line 176. The MFP 500 is connected to the communication line 120 via the communication line 126 and can communicate with the electric power control server 101 and the computer 104. The accessory 550 and the MFP 500 can cooperatively perform operations.

The accessory 550 is a device capable of performing post-processing, such as sorting, stapling, punching, folding, and cutting, on a paper (i.e., a recording sheet) printed by the MFP 500. Electric power can be supplied to the accessory 550 via a power line 177. The accessory 550 can communicate with the MFP 500. A configuration example of the MFP 500 and the accessory 550 is described in detail below.

Next, the computer 104 and the display device 105 of the computer system 100*b* are described in detail below. The computer 104 is a personal computer (PC) that can be operated by a user. Electric power can be supplied to the computer 104 via a power line 174. The computer 104 is connected to the communication line 120 via a communication line 124 and can communicate with the electric power control server 101 and the MFP 500. The display device 105 is an apparatus capable of displaying information about the computer 104. Electric power can be supplied to the display device 105 via a power line 175. The display device 105 is, for example, a cathode ray tube (CRT), a liquid crystal display, a plasma display, or a light-emitting diode (LED). The display device 105 can communicate with the PC 104.

The electric power meters 114, 115, 116, and 117 can measure the amount of electric power supplied to the computer 104, the display device 105, the MFP 500, and the accessory 550, respectively. The electric power meters 114, 115, 116, and 117 are similar to the electric power meters 112 and 113 described in the first exemplary embodiment and therefore detailed description thereof will be avoided.

Each of the communication lines 126 and 124 is, for example, Ethernet (registered trademark) type. However, each of the communication lines 126 and 124 is not limited to the above-mentioned example and can be a wired communication type, such as RS-232 or Power Line Communication (PLC). Further, each of the communication lines 120 and 160 can be a wireless communication type, such as wireless LAN, Bluetooth (registered trademark), ZigBee (registered trademark), or Radio Frequency IDentification (RFID).

Similar to the apparatus system 100 according to the first exemplary embodiment, the printer system 100*a* and the computer system 100*b* cannot perform operations at least partly when no electric power is supplied to any one of the plug sockets (or power lines). For example, the printer system 100*a* cannot perform a printing operation when no electric power is supplied to any one of the plug sockets (or power lines). More specifically, the MFP 500 cannot print an image on a print medium (e.g., a paper) when no electric power is supplied to the MFP 500 via the power line 176. The accessory 550 cannot discharge a print medium printed by the MFP 500 when no electric power is supplied to the accessory 550 via the power line 177.

Further, the computer system 100*b* cannot perform operations at least partly when no electric power is supplied to any one of the plug sockets (or power lines). For example, the computer system 100*b* cannot display any image on the screen thereof. When the computer system 100*b* cannot display any image on the screen, a user cannot operate the computer system 100*b* directly. In the electric power control system according to the second exemplary embodiment, the printer system 100*a* and the computer system 100*b* perform similar power control processing. In the following description, mainly an operation that can be performed by the printer system 100*a* is described in detail.

Figure 5:
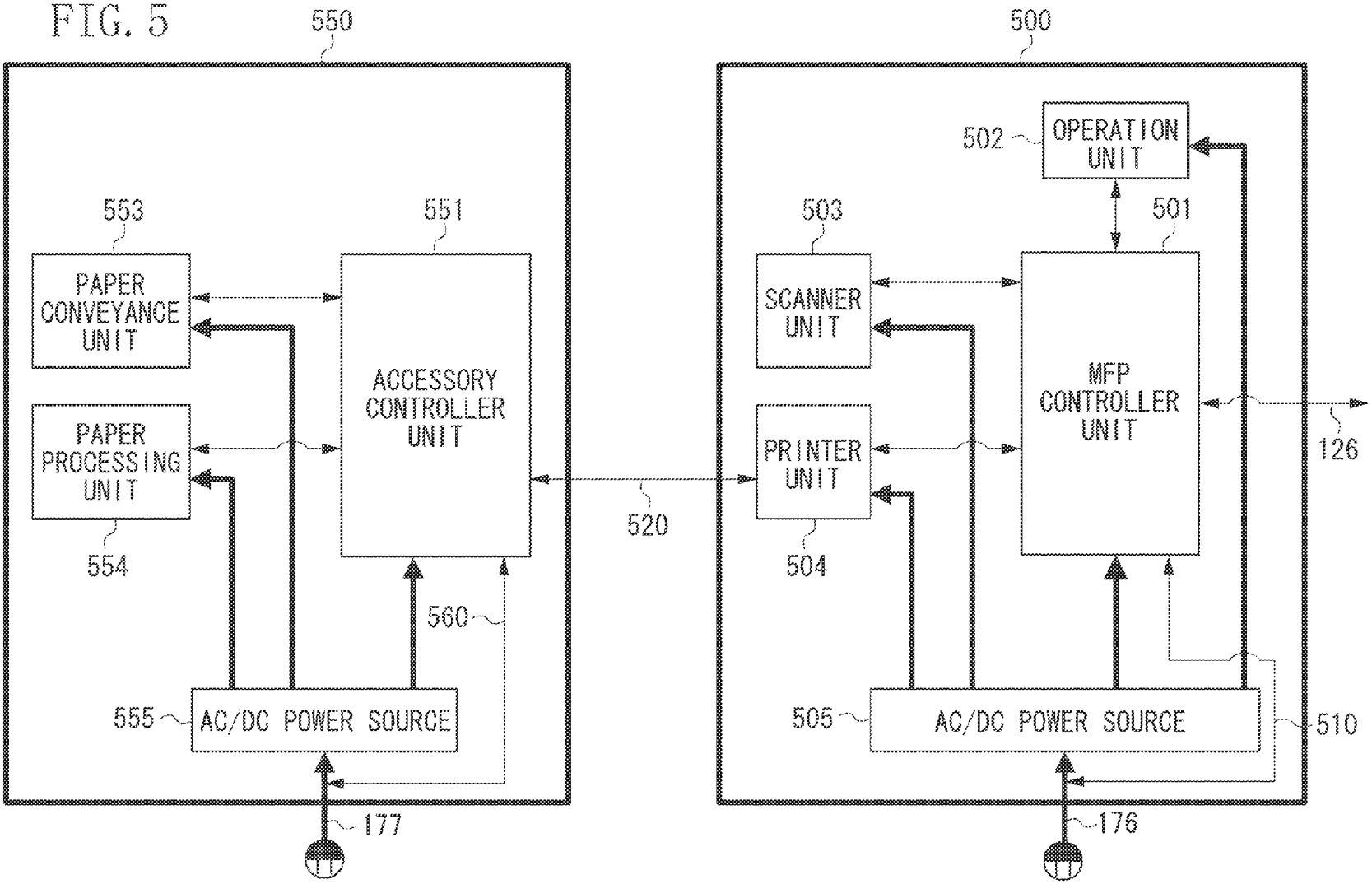
FIG. 5 illustrates an example of a configuration of a print system.

FIG. 5 illustrates a configuration example of the MFP 500 and the accessory 550. The MFP 500 includes a scanner unit 503, which is functionally operable as an image reading unit configured to read a document placed by a user and generate image data. For example, the scanner unit 503 exposes a document placed on a document positioning glass to a document illumination lamp constituted by a halogen lamp, receives reflection light from the document with a CCD sensor, and outputs an image signal.

The MFP 500 includes a printer unit 504, which is functionally operable as an image forming unit configured to form an electrostatic latent image by exposing a photosensitive member with light based on image data, develop the formed electrostatic latent image with a developer (toner particles), and print an image on a recording paper by transferring the developed image to the recording paper. The printer unit 504 includes a communication I/F that can communicate with the accessory 550. The printer unit 504 is connected to the accessory 550 via an accessory communication line 520. The scanner unit 503 and the printer unit 504 can be configured to have conventionally known configurations and functions. Therefore, detailed description thereof will be avoided.

The MFP 500 includes an operation unit 502, which is a user interface (UI) that can display information about the MFP on a screen of the liquid crystal display and can detect a user operation that is input via a key switch or a touch panel. The MFP 500 includes an MFP controller unit 501, which is connected to each of the scanner unit 503, the printer unit 504, the operation unit 502, and an external I/F (e.g., LAN) and is functionally operable as a controller unit configured to control image information and device information.

The MFP 500 includes an alternating current-direct current (AC/DC) power source 505, which can convert alternating current supplied from the power line 176 into direct current usable in the MFP 500. The AC/DC power source 505 can be configured to have conventionally known configuration and functions. Therefore, detailed description thereof will be avoided. A communication line 510 is a plug socket detection communication line, which is provided to detect a plug socket into which the insertion plug of the MFP 500 is put. The plug socket detection communication line 510 is described in detail below.

The MFP 500 and the accessory 550 can use the accessory communication line 520 to transmit an operation instruction from the MFP 500 to the accessory 550 and transmit status notification, such as error or staple remaining amount, from the accessory 550 to the MFP 500. The accessory communication line 520 can be configured to have conventionally known configuration and functions. Therefore, detailed description thereof will be avoided. Further, as mentioned above, the MFP 500 can use the communication line 126 to communicate with the electric power control server 101 and the computer 104. The communication line 126 is already described. Therefore, detailed description thereof will be avoided.

A configuration example of the accessory 550 will be described in detail below. The accessory 550 includes a paper conveyance unit 553, which is constituted by a motor and rollers capable of cooperatively conveying a paper and a machine mechanism capable of switching a conveyance path of the paper. The paper conveyance unit 553 is configured to receive a paper printed by the MFP 500 and discharge the paper to the outside of the accessory 550 after being conveyed through the accessory 550.

The accessory 550 includes a paper processing unit 554, which can perform various processing (e.g., sorting, stapling, punching, folding, and cutting) on the paper printed by the MFP 500 according to an instruction from the MFP 500. The paper conveyance unit 553 and the paper processing unit 554 can be configured to have conventionally known configurations and functions. Therefore, detailed description thereof will be avoided.

The accessory 550 includes an accessory controller unit 551, which can control the paper conveyance unit 553 and the paper processing unit 554 and is connected to the MFP 500 to control image information and device information. The accessory controller unit 551 includes a communication I/F that can communicate with the MFP 500 and is connected to the MFP 500 via the accessory communication line 520.

The accessory 550 includes an AC/DC power source 555, which can be configured to have conventionally known configuration and functions. Therefore, detailed description thereof will be avoided. The accessory 550 includes a communication line 560, which is provided to detect a plug socket into which the insertion plug of the accessory 550 is put. The plug socket detection communication line is described in detail below.

Figure 6:
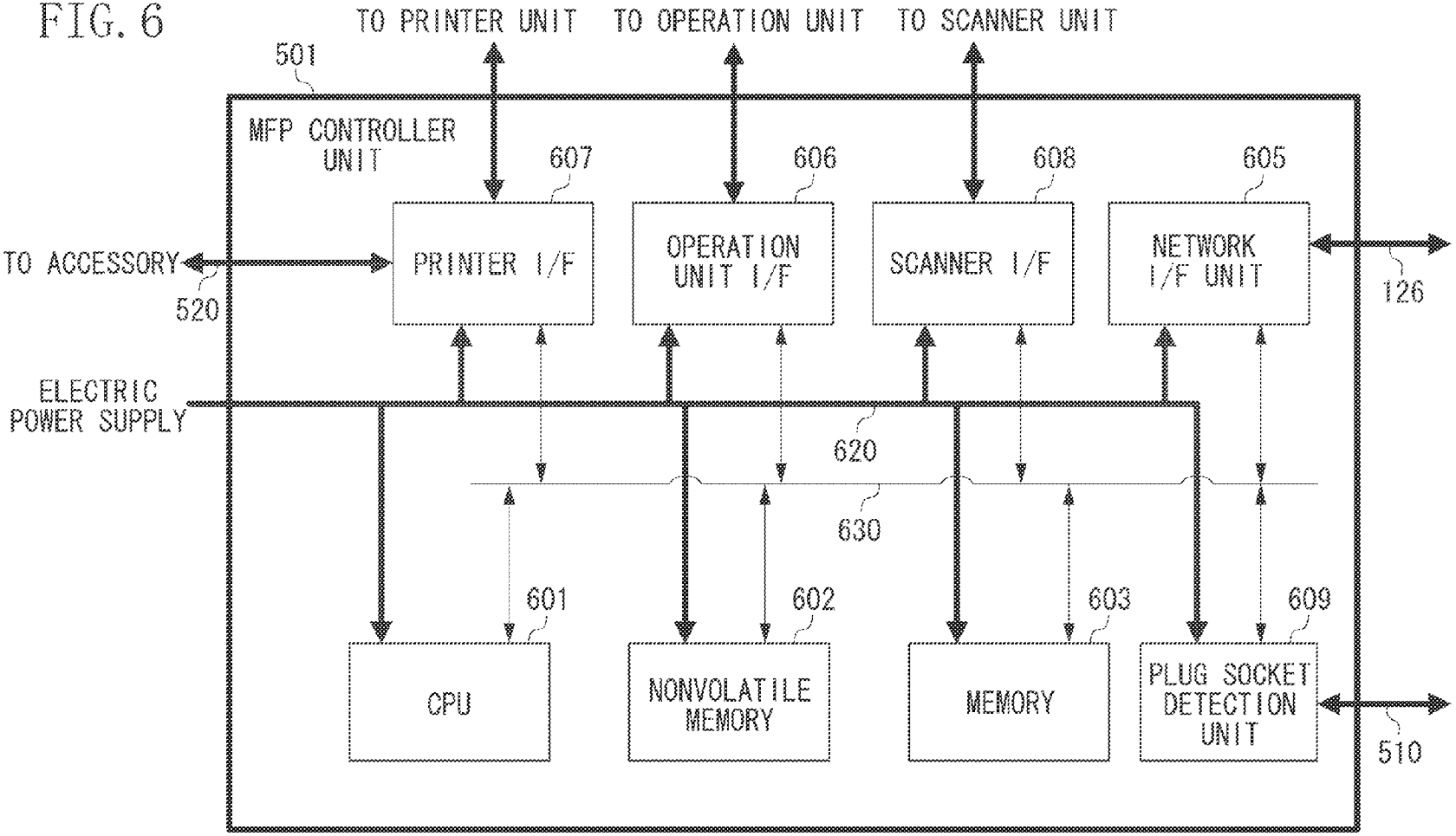
FIG. 6 illustrates an example of a configuration of an MFP controller unit.

Next, a configuration of the MFP controller unit 501 is described in detail below with reference to FIG. 6. FIG. 6 illustrates an example of the configuration of the MFP controller unit 501. In FIG. 6, a CPU 601 can execute various programs, including control processing routines described below. The CPU 601 is functionally operable as a detection unit, a notification unit, and a power source control unit of a printer system according to the present exemplary embodiment.

The MFP controller unit 501 includes a nonvolatile memory 602 (e.g., ROM or a hard disk). The nonvolatile memory 602 stores a startup program for the CPU 601 and various programs including the control processing routines. The MFP controller unit 501 includes a memory 603 (e.g., RAM), which can be used as a work area when the CPU 601 executes various programs or an image memory that temporarily stores image data.

A network I/F unit (hereinafter, referred to as "NIC") 605 is connected to the LAN and can perform various network controls, including transmission/reception of electronic mails and input/output of PDL data from/to a host computer. The MFP controller unit 501 includes an operation unit I/F 606, which is an interface (I/F) usable to communicate with the operation unit 502. The MFP controller unit 501 includes a printer I/F 607, which is an interface (I/F) connected to the printer unit 504. For example, the printer I/F 607 performs printer image processing (e.g., printer correction and resolution conversion) on print output image data and transfers print data to the printer unit 504.

The MFP controller unit 501 includes a scanner I/F 608, which is an interface (I/F) connected to the scanner unit 503. For example, the scanner I/F 608 can perform scanner image processing (including correction, modification, editing) on input data received from the scanner unit 503.

The MFP controller unit 501 includes a plug socket detection unit 609, which can detect a plug socket into which the insertion plug of the MFP 500 is put. For example, the plug socket detection unit 609 detects the plug socket into which the insertion plug of the MFP 500 is put by reading RFID information provided for the plug socket of the electric power meter 116. The RFID reading portion can be configured to have conventionally known configuration and functions. Therefore, detailed description thereof will be avoided.

Electric power can be supplied to each unit of the MFP controller unit 501 via a power source line 620. The above-mentioned units of the MFP controller unit 501 can communicate with each other via a bus 630.

Figure 7:
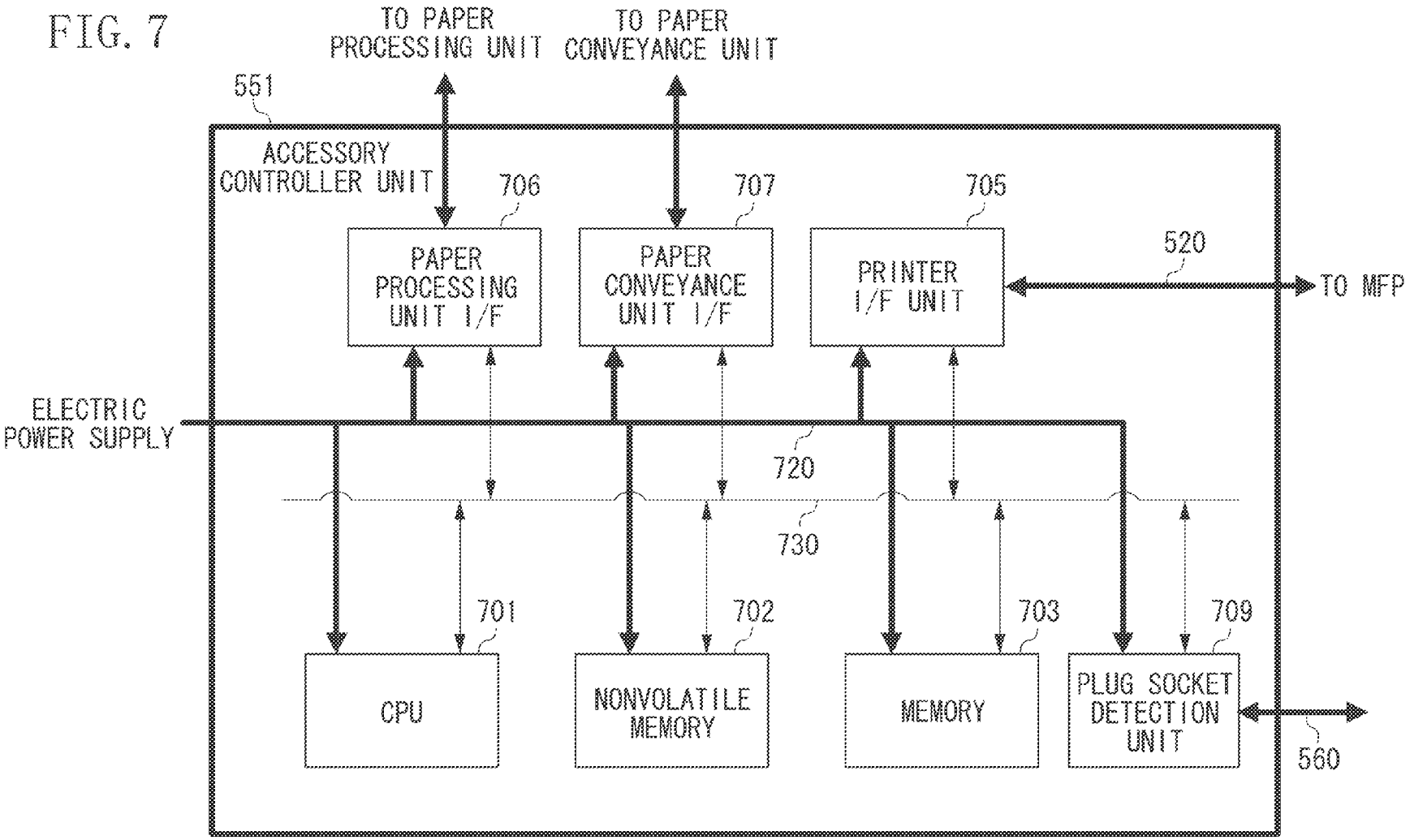
FIG. 7 illustrates an example of a configuration of an accessory controller unit.

Next, a configuration of the accessory controller unit 551 is described in detail below with reference to FIG. 7. FIG. 7 illustrates an example of the configuration of the accessory controller unit 551. In FIG. 7, a CPU 701 can execute various programs, including control processing routines described below. The CPU 701 is functionally operable as a notification unit for notifying the accessory configuration according to the present exemplary embodiment by executing the programs and controlling devices and units.

The accessory controller unit 551 includes a nonvolatile memory 702 (e.g., ROM). The nonvolatile memory 702 stores a startup program for the CPU 701 and various programs including control processing routines described below. The accessory controller unit 551 includes a memory 703 (e.g., RAM), which can be used as a work area when the CPU 701 executes various programs.

The accessory controller unit 551 includes a printer I/F unit 705, which is an interface (I/F) connected to the printer unit 504 of the MFP 500 to control communications to be performed with the MFP 500. The accessory controller unit 551 includes a paper processing unit I/F 706, which is an interface (I/F) usable to communicate with the paper processing unit 554. The accessory controller unit 551 includes a paper conveyance unit I/F 707, which is an interface (I/F) usable to communicate with the paper conveyance unit 553.

The accessory controller unit 551 includes a plug socket detection unit 709, which can detect a plug socket into which the insertion plug of the accessory 550 is put. For example, the plug socket detection unit 709 detects the plug socket into which the insertion plug of the accessory 550 is put by reading RFID information provided for the plug socket of the electric power meter 117. The RFID reading portion can be configured to have conventionally known configuration and functions. Therefore, detailed description thereof will be avoided.

Electric power can be supplied to each unit of the accessory controller unit 551 via a power source line 720. The above-mentioned units of the accessory controller unit 551 can communicate with each other via a bus 730.

Figure 8A:
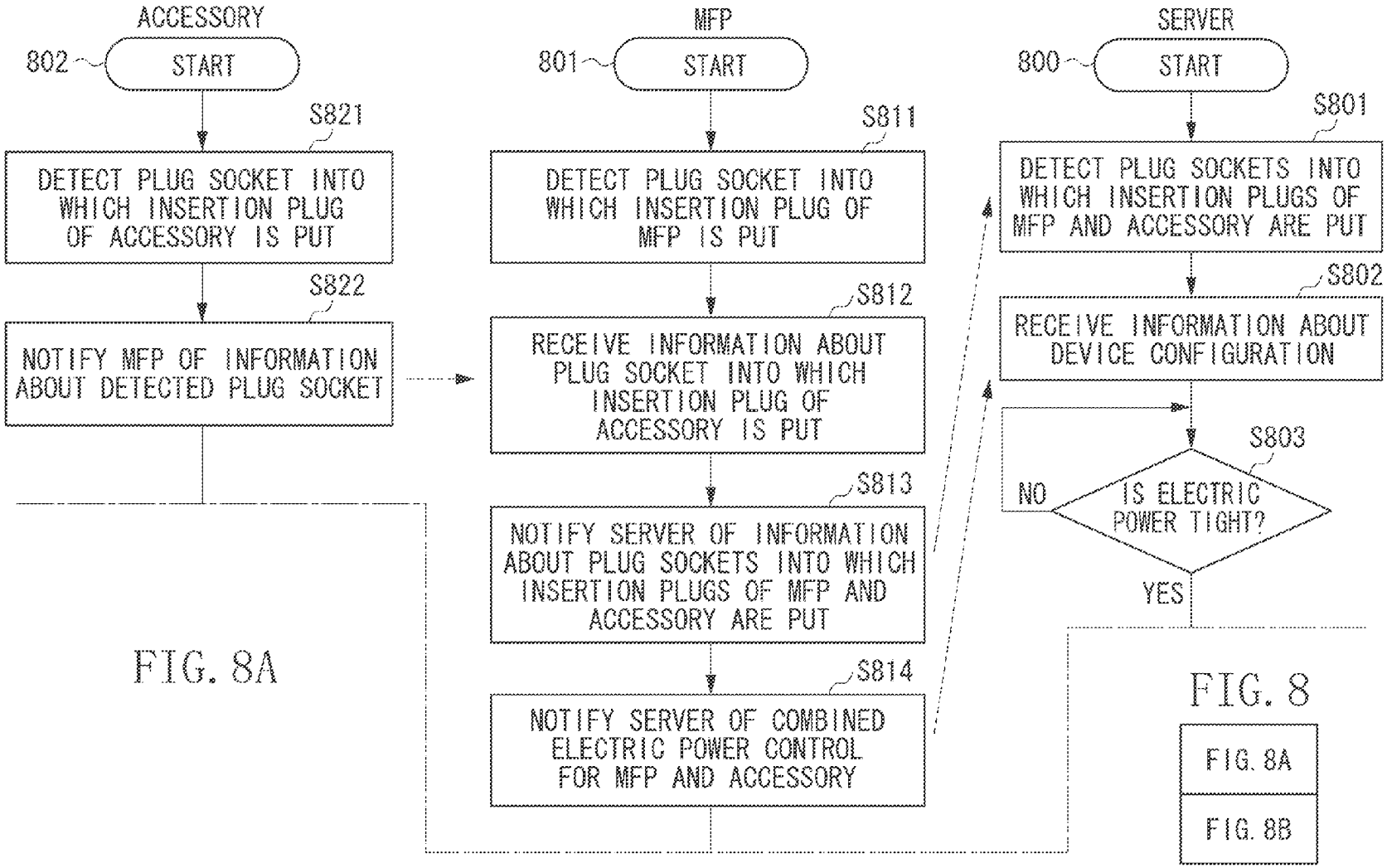
FIG. 8A and FIG. 8B, is a flowchart illustrating an operation that can be performed by the electric power control system according to the second exemplary embodiment.
Figure 8B:
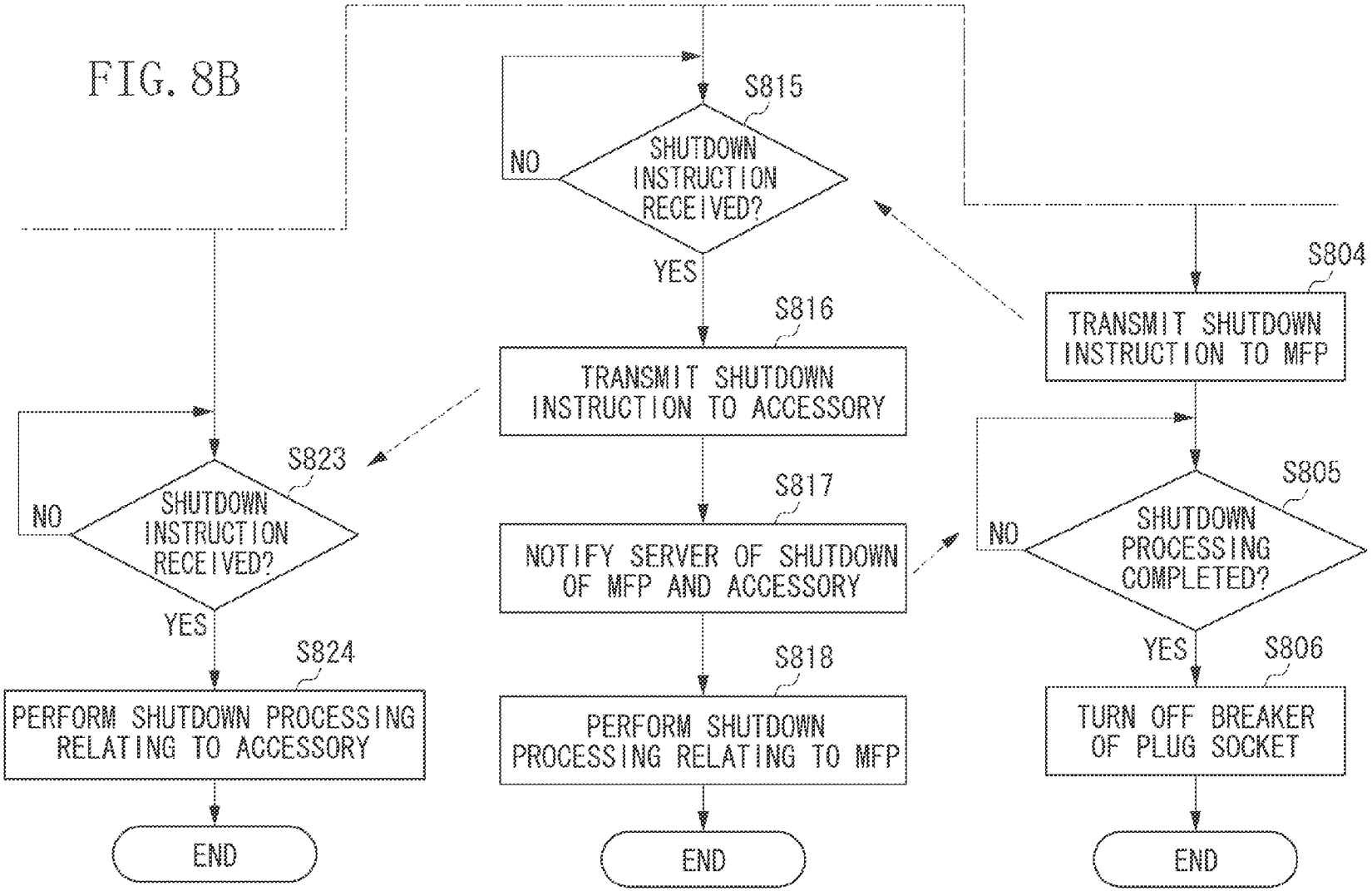

Next, operations that can be performed by the printer system 100*a* and the electric power control server 101 according to the second exemplary embodiment is described in detail below with reference to FIG. 8. FIG. 8 is a flowchart illustrating an example of the operations that can be performed by the printer system 100*a* and the electric power control server 101 according to the second exemplary embodiment.

In FIG. 8, a flowchart 800 illustrates processing that can be executed by the CPU 1201 provided in the electric power control server 101. A program including the flowchart 800 is stored in the memory 1203, the nonvolatile memory 1202, or the storage device 1204 of the electric power control server 101. Further, a flowchart 801 illustrates processing that can be executed by the CPU 601 of the MFP 500. A program including the flowchart 801 is stored in the nonvolatile memory 602 or the memory 603 of the MFP 500. Further, a flowchart 802 illustrates processing that can be executed by the CPU 701 of the accessory 550. A program including the flowchart 802 is stored in the nonvolatile memory 702 or the memory 703 of the accessory 550.

First, an operation that can be performed by the accessory 550 step by step is described in detail below with reference to the flowchart 802. In step S821, the accessory 550 detects a plug socket into which the insertion plug of the accessory 550 is put. For example, the plug socket detection unit 709 of the accessory 550 can detect ID information about the plug socket into which the insertion plug of the accessory 550 is put by reading RFID information provided for the electric power meter 117.

Next, in step S822, the accessory 550 notifies the MFP 500 of ID information about the plug socket into which the insertion plug of the accessory 550 is put, which has been detected in the above-mentioned step S821, via the communication line 520. In the present exemplary embodiment, the plug socket ID is plug socket unique ID usable to identify each plug socket (see 903 in FIG. 9). In the present exemplary embodiment, the data (character string) of the plug socket ID is in a format easy for a user to recognize. However, any other data format (e.g., binary value or alphanumeric data) that can be easily managed by the electric power control server 101 is employable as the data format of the plug socket ID. For example, MAC address or IP address of each electric power meter is usable as the plug socket ID 903 (see FIG. 9).

In a case where the electric power meter 117 is configured to read the RFID information provided for the insertion plug attached to the distal end of the power line 177 of the accessory 550 as described below, the accessory 550 notifies the MFP 500 of the RFID information about the insertion plug attached to the distal end of the power line 177 of the accessory 550 in the above-mentioned step S822. Further, in a case where the MFP 500 is configured to read the RFID information about the power line 177 of the accessory 550, the above-mentioned processing in step S822 is unnecessary.

Next, in step S823, the accessory 550 determines whether a power shutdown preparatory processing instruction (i.e., "shutdown instruction" described in FIG. 8) has been received. For example, the accessory 550 waits for a while until a signal or a command indicating the power shutdown preparatory processing instruction is received from the MFP 500. In the present exemplary embodiment, the accessory 550 is configured to receive the power shutdown preparatory processing instruction from the MFP 500 as described above. However, the present exemplary embodiment can be modified appropriately. For example, the accessory 550 can be configured to receive a preparatory processing instruction for the power shutdown from the electric power control server 101. If the accessory 550 determines that the preparatory processing instruction for the power shutdown has been received (Yes in step S823), the operation proceeds to step S824.

Next, in step S824, the accessory 550 performs power shutdown preparatory processing (i.e., "shutdown processing" described in FIG. 8) relating to the accessory 550. For example, the accessory 550 performs the power shutdown preparatory processing after the discharge operation has been completed in the accessory 550. In a case where there is a plurality of accessories that are mutually connected, if the accessory 550 receives the power shutdown preparatory processing instruction, the accessory 550 can transmit a preparatory processing instruction for the power shutdown to another accessory that receives the processed paper from the accessory 550 before the accessory 550 starts the power shutdown preparatory processing. In this case, the accessory 550 performs the power shutdown preparatory processing after the discharge operation has been completed in the accessory 550.

Next, an operation that can be performed by the MFP 500 step by step is described in detail below with reference to the flowchart 801. In step S811, the MFP 500 detects a plug socket into which the insertion plug of the MFP 500 is put. For example, the plug socket detection unit 609 of the MFP 500 can detect ID information about the plug socket into which the insertion plug of the MFP 500 is put by reading RFID information provided for the electric power meter 116.

Next, in step S812, the MFP 500 receives the ID information about the plug socket into which the insertion plug of the accessory 550 is put. For example, the MFP 500 receives the plug socket ID from the accessory 550 via the communication line 520. In this case, the MFP 500 can obtain RFID information about the power line 177 of the accessory 550 that can be directly read by the plug socket detection unit 609 of the MFP 500.

Next, in step S813, the MFP 500 notifies the electric power control server 101 of the ID information about the plug sockets into which the insertion plugs of the MFP 500 and the accessory 550 are put via the communication line 126. The plug socket ID is described in detail in FIG. 9 (see 903). In a case where the electric power meters 116 and 117 are configured to read RFID information about the insertion plugs of the MFP 500 and the accessory 550 as described below, the above-mentioned processing in steps S811, S812, and S813 is unnecessary.

Next, in step S814, for example, the MFP 500 notifies the electric power control server 101 of information about the device configuration of the printer system 100*a*. The information about the device configuration of the printer system 100*a* is information identifying a device that requires electric power to enable the printer system 100*a* to operate normally. The information about the device configuration of the printer system 100*a* includes information about a combination of the MFP 500 and the accessory 550 to be subjected to the power shutdown processing. For example, in step S814, the MFP 500 transmits IP address about the MFP 500.

First, the MFP 500 transmits IP address information about the accessory 550 (i.e., the device to be subjected to the power source control together with the MFP 500). In the present exemplary embodiment, the processing to be performed by the MFP 500 in step S814 is transmitting IP addresses of the MFP 500 and the accessory 550 for illustrative purposes. Alternatively, the MFP 500 can transmit identification information (e.g., MAC address) about each of the MFP 500 and the accessory 550. In the present exemplary embodiment, the power shutdown processing is performed simultaneously for the MFP 500 and the accessory 550. However, in a case where the power shutdown (power shutdown preparatory) processing is differentiated for each of the MFP 500 and the accessory 550, the above-mentioned information about the device configuration of the printer system 100*a* can include the information about the differentiation (e.g., order or time difference).

Next, in step S815, the MFP 500 determines whether a power shutdown preparatory processing instruction (i.e., "shutdown instruction") has been received. For example, the MFP 500 waits for a while until a signal or a command indicating the preparatory processing instruction for the power shutdown is received from the electric power control server 101 via the communication line 126. The processing to be performed in step S815 is similar to the processing performed in step S213 and therefore detailed description thereof will be avoided. If the MFP 500 determines that the preparatory processing instruction for the power shutdown has been received (Yes in step S815), the operation proceeds to step S816.

Next, in step S816, the MFP 500 transmits a preparatory processing instruction for power shutdown (i.e., "shutdown instruction") to the accessory 550. For example, the MFP 500 transmits a signal or a command indicating the preparatory processing instruction for the power shutdown to the accessory 550 via the communication line 520. If the MFP 500 starts the power shutdown preparatory processing, the printer system 100*a* cannot operate normally even when electric power is continuously supplied to the accessory 550. Therefore, if the MFP 500 receives the preparatory processing instruction for the power shutdown directed to the MFP 500, the MFP 500 transmits the preparatory processing instruction for the power shutdown to the accessory 550.

Next, in step S817, the MFP 500 transmits a notification to the electric power control server 101 via the communication line 126 to inform that the preparatory processing instruction for the power shutdown has been transmitted to the accessory 550. The MFP 500 can notify the electric power control server 101 of completion time of the power shutdown preparatory processing (i.e., "shutdown processing") performed in each of the MFP 500 and the accessory 550.

Next, in step S818, the MFP 500 performs power shutdown preparatory processing (i.e., "shutdown processing") relating to the MFP 500. For example, the power shutdown preparatory processing to be performed by the MFP 500 is saving the contents of the memory 603 in a nonvolatile memory (e.g., a hard disk). Further, the power shutdown preparatory processing includes interrupting the print processing of the MFP 500, discharging papers from the printer unit 504 of the MFP 500, and cooling a fixing heater of the printer unit 504. The power shutdown preparatory processing can be realized by a conventionally known printer that has a general configuration and performs general processing. Therefore, detailed description thereof will be avoided.

Next, an operation to be performed by the electric power control server 101 is described in detail below with reference to the flowchart 800. In step S801, the electric power control server 101 detects plug sockets into which insertion plugs of the MFP 500 and the accessory 550 are put. In the present exemplary embodiment, the electric power control server 101 receives the plug socket ID information about each of the MFP 500 and the accessory 550 transmitted in the step S813.

Although the MFP 500 or the accessory 550 is configured to read RFID information about the electric power meters 116 and 117 and the electric power control server 101 receives the plug socket ID information transmitted from the MFP 500 or the accessory 550, the system configuration is not limited to the above-mentioned example.

For example, the electric power meters 116 and 117 can be configured to read RFID information about the power lines 176 and 177 of the MFP 500 and the accessory 550 and transmit the read RFID information to the electric power control server 101, so that the electric power control server 101 can detect ID information about the plug sockets into which the insertion plugs of the MFP 500 and the accessory 550 are put.

Next, in step S802, the electric power control server 101 receives the information about the device configuration of the printer system 100*a* from the MFP 500. The information about the device configuration of the printer system 100*a* is information identifying a device that requires electric power to enable the printer system 100*a* to operate normally. The information about the device configuration of the printer system 100*a* includes information about a combination of the MFP 500 and the accessory 550 to be subjected to the power shutdown processing.

For example, the information identifying the device that requires electric power is device unique information (e.g., IP address or MAC address) about the MFP 500 and the accessory 550. Based on the received configuration information, the electric power control server 101 generates a power source management table (e.g., as illustrated in FIG. 9) that can be used to manage the device unique information (e.g., IP address or MAC address) about the electric power meters connected to the MFP 500 and the accessory 550. The power source management table is described in detail below.

Next, in step S803, the electric power control server 101 determines whether the electric power is in a tight state with respect to the power source systems (i.e., the power lines 130, 140, and 150) of the electric power control server 101, the MFP 500, and the accessory 550 with reference to the above-mentioned power source management table.

The processing to be performed in step S803 is similar to the processing performed in step S202 illustrated in FIG. 2 and therefore detailed description thereof will be avoided. If it is determined that the electric power is not tight (No in step S803), the electric power control server 101 repeats the determination processing in step S803. On the other hand, if it is determined that the electric power is tight (Yes in step S803), the operation of the electric power control server 101 proceeds to step S804.

In step S804, the electric power control server 101 instructs the printer system 100*a* (i.e., the device connected to the power line whose electric power is tight) to perform power shutdown preparatory processing. For example, when the electric power of the power line 150 is tight, the electric power control server 101 instructs the MFP 500 (i.e., the device connected to the power line 150) to perform power shutdown preparatory processing, with reference to the power source management table described below. Further, the electric power control server 101 may instruct the accessory 550 (i.e., the device that constitutes the printer system 100*a* together with the MFP 500) to perform power shutdown preparatory processing, with reference to the power source management table described below.

In the present exemplary embodiment, for illustrative purposes, the electric power control server 101 sequentially transmits the preparatory processing instructions for the power shutdown to the MFP 500 and the accessory 550 in this order. However, any modification is acceptable if the MFP 500 and the accessory 550 can prepare for the power shutdown processing. However, for example, as a modified embodiment, the electric power control server 101 can simultaneously transmit the preparatory processing instruction for the power shutdown to both of the MFP 500 and the accessory 550.

Alternatively, the electric power control server 101 can sequentially transmit the power shutdown preparatory processing instructions to the accessory 550 and the MFP 500 in this order. Further, the electric power control server 101 can transmit the preparatory processing instruction for the power shutdown to either the MFP 500 or the accessory 550. Further, the electric power control server 101 can transmit an electric power shutdown notification, instead of transmitting the preparatory processing instruction for the power shutdown.

Next, in step S805, the electric power control server 101 determines whether the power shutdown preparatory processing has been completed in the printer system 100*a*. For example, the electric power control server 101 can be configured to receive a notification relating to completion time of the power shutdown preparatory processing in the MFP 500 and the accessory 550 in a case where the electric power control server 101 has instructed the MFP 500 to perform the power shutdown preparatory processing in the above-mentioned step S804.

Further, in determining whether the device connected to the power line whose electric power is tight (i.e., the MFP 500 or the accessory 550 in the present exemplary embodiment) has shut down, the electric power control server 101 can communicate with an output meter connected to the device to monitor the electric power consumption and can determine that the shutdown processing has been completed when the electric power consumption reaches a predetermined value (i.e., a power consumption value in a shutdown completion state).

The power consumption value in the shutdown completion state of each device can be registered beforehand in the electric power control server 101 or can be acquired in the above-mentioned step S201.

Further, in a case where the above-mentioned information about the device configuration acquired in step S802 includes time required for the device to complete the shutdown processing, the electric power control server 101 can determine that the shutdown processing of the device has been completed when the time has elapsed. The time required for each device to complete the shutdown processing can be registered beforehand in the electric power control server 101. Further, after transmitting the shutdown instruction in the above-mentioned step S804, the electric power control server 101 can receive the completion time of the power shutdown preparatory processing (i.e., "shutdown processing") in the MFP 500 or the accessory 550 from the MFP 500.

If the electric power control server 101 determines that the power shutdown preparatory processing is not yet completed in the apparatus system 100 connected to the power line whose electric power is tight (No in step S805), the electric power control server 101 repeats the determination processing in step S805. On the other hand, if the electric power control server 101 determines that the power shutdown preparatory processing has been completed in the apparatus system 100 connected to the power line whose electric power is tight (Yes in step S805), the operation proceeds to step S806.

Next, in step S806, the electric power control server 101 instructs the electric power meter connected to the device determined in the above-mentioned step S805 as having completed the power shutdown preparatory processing to stop the electric power supply operation (turn off the breaker of the plug socket illustrated in FIG. 8). The configuration and processing for stopping the electric power supply operation is similar to those described in step S205 and therefore detailed description thereof will be avoided.

Next, the power source management table employable for the electric power control system according to the second exemplary embodiment is described in detail below with reference to FIG. 9. FIG. 9 illustrates an example of the power source management table that indicates power lines to which the printer system 100*a* and the computer system 100*b* illustrated in FIG. 4 are connected, communication destinations of the printer system 100*a* and the computer system 100*b*, and a relationship between constituent devices of the printer system 100*a* and the computer system 100*b* to be subjected to the power source shutdown processing.

The power source management table is stored in the memory 1203 or the storage device 1204 of the electric power control server 101. Further, the power source management table illustrated in FIG. 3 can be generated in step S801 or step S802 illustrated in FIG. 8 (i.e., by the processing to be performed by the CPU 1201 provided in the electric power control server 101) and can be referred to in step S803, step S804, step S805, step S806. Data (character string) of FIG. 8 is in a format easy for a user to recognize. However, any other data format (e.g., binary value or alphanumeric data) that can be easily managed by the electric power control server 101 is employable as the data format of FIG. 8.

In FIG. 9, a data string 901 indicates device name of each device (i.e., each of the MFP 500 and the accessory 550). The device name 901 is similar to the device name 301 illustrated in FIG. 3 and therefore detailed description thereof will be avoided. A data string 902 indicates power source system (power line) to which each device of the device name 301 is connected. The power source system (power line) 902 is similar to the power source system (power line) 302 illustrated in FIG. 3 and therefore detailed description thereof will be avoided.

A data string 903 indicates plug socket ID usable to identify a plug socket and an electric power meter to which each device of the device name 901 is connected. The plug socket ID 903 is information differentiated for each plug socket to uniquely identify the plug socket and the electric power meter. The value detected in step S801 of the flowchart illustrated in FIG. 8 or ID information about the RFID provided for each electric power meter can be stored as the plug socket ID 903.

In a case where RFID information is referred to in detecting the plug socket IDs of the plug sockets into which the insertion plugs of the MFP 500 and the accessory 550 are put, RFID values notified from the MFP 500 and the accessory 550 are stored as the plug socket ID 903 in respective lines corresponding to the MFP 500 and the accessory 550. Alternatively, the plug socket ID 903 can be similar to the plug socket ID 303 illustrated in FIG. 3. In this case, detailed description thereof will be avoided.

A data string 904 indicates communication destination of an electric power meter to which each device of the device name 901 is connected. The communication destination 904 is similar to the communication destination 304 illustrated in FIG. 3 and therefore detailed description thereof will be avoided. A data string 905 indicates communication destination of each device of the device name 901. The communication destination 905 is similar to the communication destination 305 illustrated in FIG. 3 and therefore detailed description thereof will be avoided. A data string 906 indicates a device that constitutes the apparatus system together with the device of the device name 901. The data 906 is similar to the data 306 illustrated in FIG. 3 and therefore detailed description thereof will be avoided.

The power source management table illustrated in FIG. 9 includes information relating to the printer system 100*a* described in a data row 910. More specifically, information relating to the MFP 500 is described in an upper part of the data row 910 and information relating to the accessory 550 is described in a lower part of the data row 910. Further, the power source management table illustrated in FIG. 9 includes information relating to the computer system 100*b* described in data row 911. More specifically, information relating to the PC 104 is described in an upper part of the data row 911 and information relating to the display device 105 is described in a lower part of the data row 911.

Figure 10:
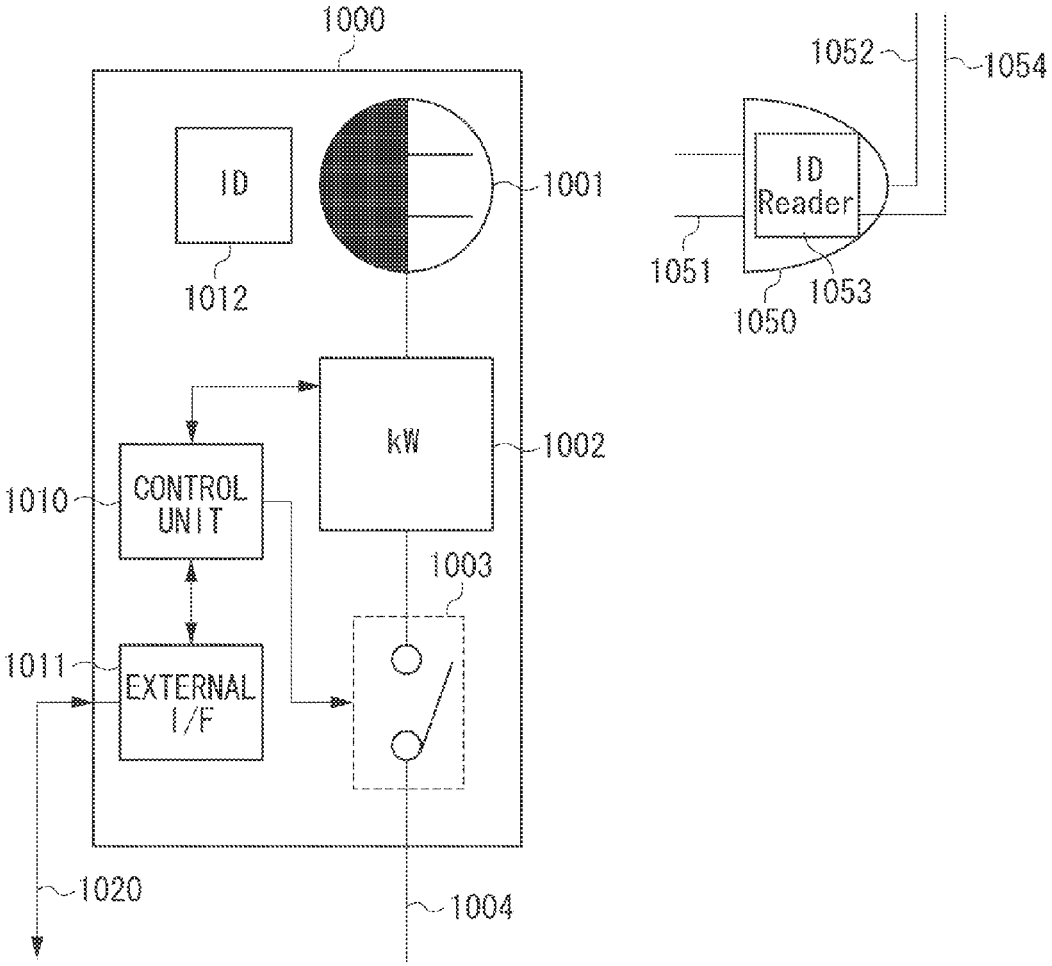
FIG. 10 illustrates a configuration example of an electric power meter.

Next, examples of the electric power meter are described in detail below with reference to FIGS. 10 and 11. FIG. 10 illustrates a configuration example of the electric power meters 111, 112, 113, 114, 115, 116, and 117 illustrated in FIGS. 1 and 4. An electric power meter 1000 illustrated in FIG. 10 is connected with an insertion plug 1050. The insertion plug 1050 is attached to a distal end of a power line connected to the electric power meter 1000. Electric power can be supplied from the electric power meter 1000 to each device (such as the MFP 500 or the accessory 550) via the insertion plug 1050.

The electric power meter 1000 has the following internal configuration. Electric power can be supplied to the insertion plug 1050 when the insertion plug 1050 is put into a socket insertion port 1001 of the electric power meter 1000. A measurement unit 1002 is configured to measure voltage/current, electric power, or electric power amount of the socket insertion port 1001 and can notify a control unit 1010 of a measurement result.

The switch 1003 is configured to selectively start or stop electric power supply to the socket insertion port 1001 in accordance with an instruction from the control unit 1010. A power line 1004 corresponds to the power lines 131, 143, 152, 134, 135, 147, and 156 illustrated in FIGS. 1 and 4.

In the electric power meter 1000, the control unit 1010 can receive the measurement result from the measurement unit 1002 and cause the switch 1003 to perform the above-mentioned switching operation and further can communicate with the electric power control server 101 via an external I/F 1011.

The external I/F 1011 is connectable to a communication line of Ethernet (registered trademark) type. In the present exemplary embodiment, the external I/F 1011 is not limited to the Ethernet (registered trademark) type and can be a wired communication type, such as RS-232 or Power Line Communication (PLC). Further, the external I/F 1011 can be a wireless communication type, such as wireless LAN, Bluetooth (registered trademark), ZigBee (registered trademark), or RFID. An IC tag 1012 (e.g., RFID) is provided to identify the plug socket ID. The electric power meter 1000 has the above-mentioned internal configuration.

The insertion plug 1050 has the following internal configuration. Electric power can be supplied when a socket insertion portion 1051 is put into the socket insertion port 1001. A power line 1052 corresponds to the power lines 171, 172, 173, 174, 175, 176, and 177 illustrated in FIGS. 1 and 4.

An IC (e.g., RFID) tag reading unit 1053 can read plug socket ID stored in the IC tag 1012 of the electric power meter 1000. A plug socket ID communication line 1054 corresponds to the communication lines 510 and 560 illustrated in FIG. 5. To read the plug socket ID, the IC tag reading unit 1053 communicates with the plug socket detection unit 609 illustrated in FIG. 6 or the plug socket detection unit 709 illustrated in FIG. 7. The insertion plug 1050 has the above-mentioned internal configuration.

Next, another configuration of the electric power meter is described in detail below with reference to FIG. 11. FIG. 11 illustrates another configuration example of the electric power meters 111, 112, 113, 114, 115, 116, and 117 illustrated in FIGS. 1 and 4. Differences between FIG. 11 and FIG. 10 are described in detail below.

Figure 11:
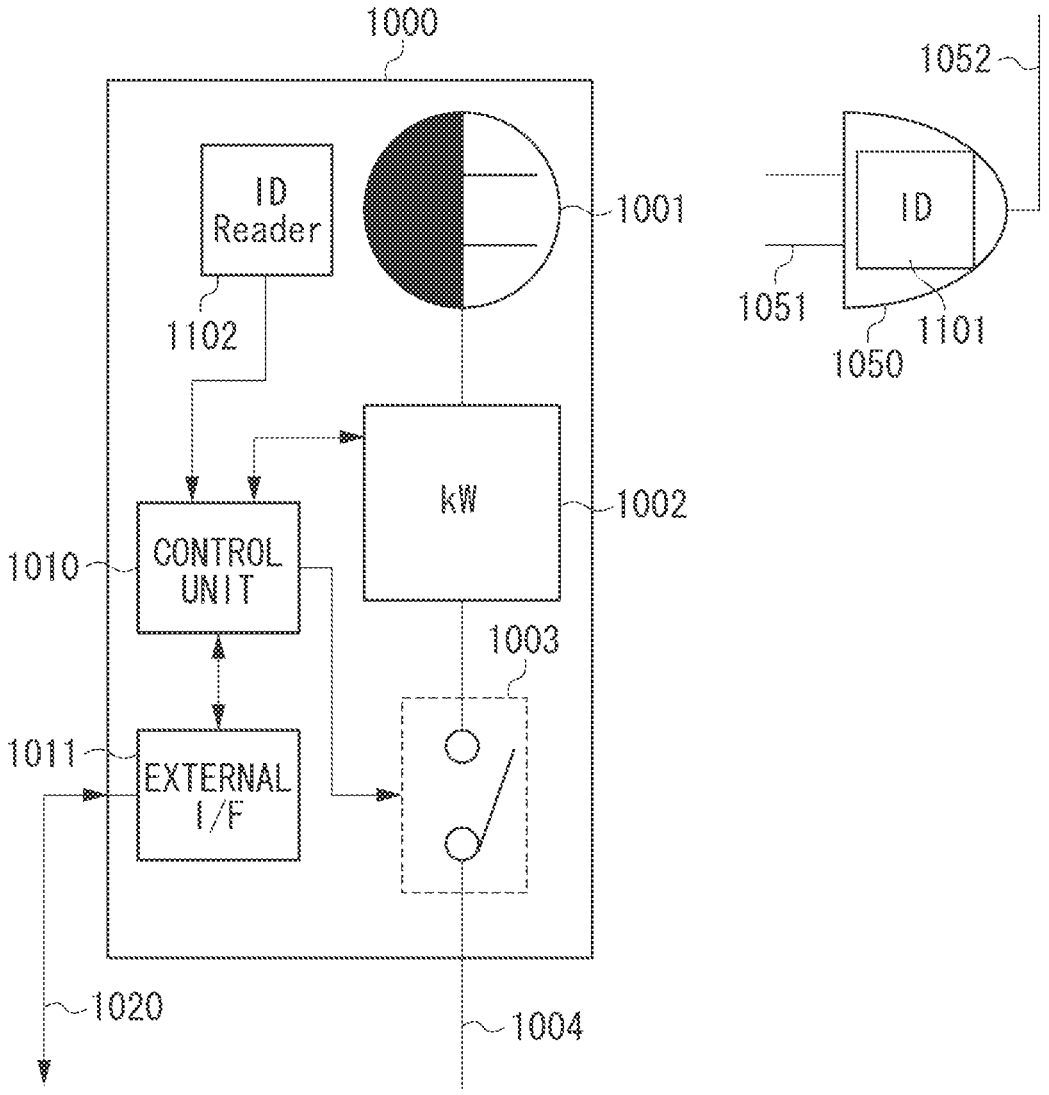
FIG. 11 illustrates another configuration example of the electric power meter.

In FIG. 11, an IC tag 1101 is RFID usable to identify the plug socket ID. An IC tag (e.g., RFID) reading unit 1102 is capable of reading ID information stored in the IC tag 1101 of the insertion plug 1050. The IC tag reading unit 1102 can notify the control unit 1010 of the read ID information. The control unit 1010 notifies the electric power control server 101 of the read ID information via the external I/F 1011.

In each of the above-mentioned exemplary embodiments, if the electric power of a specific power source system is tight, the electric power control system performs a shutdown operation in such a way as to stop the electric power supply to another cooperative load in addition to a load connected to the power source system whose electric power is tight.

However, the present invention is applicable to any other case where the electric power to be supplied to a device system should be shut down at least partly. For example, if the electric power control system receives a shutdown instruction directed to a partial load, the electric power control system can perform a shutdown operation in such a way as to stop the electric power supply to a system constituted by the above-mentioned partial load and another cooperative load.

As mentioned above, the electric power control system having the configuration illustrated in FIG. 4 can manage the power source by performing the processing of the flowchart illustrated in FIG. 8. In this case, the system can perform a shutdown operation in such a way as to completely stop the electric power supply to the apparatus system 100*a* having a plurality of plug sockets, with reference to the power source management table illustrated in FIG. 9.

As a result, in a case where the apparatus system 100*a* cannot perform operations normally, the electric power control system can prevent electric power from being continuously supplied to the electric power loads (e.g., the MFP 500 and the accessory 550) of the apparatus system 100*a*. In other words, the system can eliminate useless consumption of the electric power. Using the electric power meter illustrated in FIG. 10 or FIG. 11 is advantageous in that each plug socket can be automatically associated with a corresponding device and in that a work for constituting the electric power control system becomes easy.

As another embodiment, the printer system 100*a* may include a plurality of accessories connected to the MFP 500. Even in such a case, the system according to the present invention can perform similar electric power control for the remaining accessories (other than the accessory 550).

Further, in a case where a printer system is connected a print server that generates a print job for the MFP 500, the print server can perform processing similar to the above-mention processing performed by the MFP 500. The present invention can be applied to any printer system that includes or cooperates with a print server.

Further, the electric power loads applicable to the flowchart illustrated in FIG. 8 are not limited to the MFP 500 and the accessory 550. For example, the MFP 500 can be replaced by the PC 104 and the accessory 550 can be replaced by the display device 105. The electric power control according to the present exemplary embodiment can be realized similarly. More specifically, the present invention is applicable not only to the printer system 100*a* but also to the computer system 100*b*. In this case, the present invention is applicable to any other system including a plurality of power sources.

Further, in the above-mentioned exemplary embodiments, the electric power control server 101 is configured to receive the configuration information from a device that constitutes each apparatus configuration system as described above. However, as another exemplary embodiment, the electric power control server 101 can be configured to request a device of each apparatus configuration system to transmit the configuration information about each apparatus system.

As mentioned above, in an apparatus system including a plurality of devices, the apparatus system may not be able to operate normally if the electric power supply to any one of the devices is stopped. In such a case, the electric power control system according to the present invention stops also the electric power supply to the remaining device in the apparatus system to reduce an amount of electric power being uselessly consumed. Accordingly, the electric power control system according to the present invention can prevent electric power from being uselessly consumed in a state where the apparatus system cannot operate normally. More specifically, the electric power control system according to the present invention can reduce the amount of uselessly consumed electric power in a state where the electric power may be continuously supplied to at least a part of devices cooperatively constituting a device group.

As described above, the present invention provides an electric power control system that can measure an electric power amount and can perform a shutdown operation in such a way as to shut a part of power lines if the measured electric power amount is inappropriate. For example, the present invention is applicable to a printing apparatus, such as a printer, a digital copying machine, a digital multifunction peripheral, or a facsimile apparatus. Further, the present invention is applicable to a printing system including an accessory (e.g., a paper finisher), which is connected to a power line different from that of a printing apparatus, or a print server that generates print image data.

The configuration and contents of various data are not limited to the above-mentioned examples and therefore can be modified in various ways according to the way of usage or purposes. The present invention is not limited to some exemplary embodiments having been described above. For example, the present invention can be realized as a system, an apparatus, a method, a program, or a storage medium. More specifically, the present invention can be applied to a system including a plurality of devices or can be applied to an apparatus constituted by a single device. Further, the present invention encompasses any configuration obtainable by combining two or more exemplary embodiments described above.

(Another Exemplary Embodiment)

Further, the present invention can be realized by performing the following processing. More specifically, the processing includes supplying a software program that can realize the functions of the above-mentioned exemplary embodiments to a system or an apparatus via a network or an appropriate storage medium and causing a computer (or CPU or a micro processing unit (MPU)) of the system or the apparatus to read and execute the program. Further, the present invention can be applied to a system including a plurality of devices or can be applied to an apparatus constituted by a single device.

The present invention is not limited to the above-mentioned exemplary embodiments and can be modified in various ways (e.g., an appropriate combination of two or more exemplary embodiments) within the scope of the invention. The present invention encompasses any possible modifications within the scope of the present invention. The present invention encompasses any possible combinations obtainable based on the above-mentioned exemplary embodiments and modified embodiments thereof.

According to the present invention, the electric power control system can prevent electric power from being continuously supplied to a part of devices that constitute an apparatus system in a state where the apparatus system cannot perform operations normally, thereby reducing an amount of uselessly consumed electric power.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-260811 filed Dec. 18, 2013, which is hereby incorporated by reference herein in its entirety.

What is claimed is:

1. An electric power control system comprising:

a first device configured to perform an operation when electric power is supplied via a first plug socket;

a second device configured to perform an operation when electric power is supplied via a second plug socket, wherein the first device and the second device are connected in such a way as to communicate with each other; and an electric power control apparatus configured to control the electric power to be supplied to the first device and the second device, wherein the first device includes a notification unit configured to notify the electric power control apparatus of information indicating the second device that is a device relating to the first device, and wherein the electric power control apparatus includes an electric power control unit configured to stop supplying electric power to the second device based on the information notified from the notification unit when the electric power control unit stops supplying electric power to the first device.

2. The electric power control system according to claim 1, wherein the electric power control unit is configured to instruct the first device to perform a shutdown operation before the electric power control unit stops supplying electric power to the first device and the second device.

3. The electric power control system according to claim 2, wherein, in a case where a predetermined time has elapsed after instructing the first device to perform the shutdown operation, the electric power control unit is configured to stop supplying electric power to the first device and the second device.

4. The electric power control system according to claim 2, wherein the electric power control unit is configured to monitor electric power consumption of the first device or the second device and, in a case where the monitored electric power consumption is equal to or less than a predetermined electric power consumption, stop supplying electric power to the first device and the second device.

5. The electric power control system according to claim 1, wherein the first device includes:

a reception unit configured to receive the instruction, an execution unit configured to cause the first device to perform the shutdown operation in response to the instruction received by the reception unit, and an instruction unit configured to instruct the second device to perform a shutdown operation in response to the instruction received by the reception unit.

6. The electric power control system according to claim 5, wherein the electric power control unit is configured to stop supplying electric power to the first device and the second device after both the first device and the second device have completed the shutdown operation.

7. The electric power control system according to claim 1, wherein the notification unit of the first device is configured to notify the electric power control apparatus of configuration information about a device system including the first device and the second device, and the electric power control apparatus is configured to determine a target power supply device based on the device system configuration information received from the notification unit.

8. The electric power control system according to claim 1, wherein the first device is an image forming apparatus that forms an image on a paper, and the second device is a post-processing apparatus that performs post-processing on the paper on which the image has been formed by the image forming apparatus.

9. The electric power control system according to claim 1, wherein the first device is a print server that receives a print request from an external apparatus, and the second device is an image forming apparatus that forms an image on a paper based on image data transmitted from the print server.

10. An electric power control apparatus that can communicate with a first device configured to perform an operation when electric power is supplied via a first plug socket and a second device configured to perform an operation when electric power is supplied via a second plug socket, wherein the first device and the second device are connected in such a way as to communicate with each other, the electric power control apparatus comprising:

a reception unit configured to receive, from the first device, information indicating the second device that is a device relating to the first device;

a first instruction unit configured to generate an instruction to stop supplying electric power to the first device;

a second instruction unit configured to generate an instruction to stop supplying electric power to the second device, wherein, in a case where the first instruction unit generates the instruction to stop supplying electric power to the first device, the second instruction unit generates the instruction to stop supplying electric power to the second device based on the information received from the reception unit.

11. The electric power control apparatus according to claim 10, further comprising:

a shutdown instruction unit configured to instruct the first device to perform a shutdown operation before the electric power supply to the first device and the second device is stopped.

12. The electric power control apparatus according to claim 10, wherein the first instruction unit is configured to generate an instruction to stop supplying electric power to the first device after the first device completes the shutdown operation, and the second instruction unit is configured to generate an instruction to stop supplying electric power to the second device after the second device completes the shutdown operation.

* * * * *